US006877681B2

(12) United States Patent
Hartle et al.

(10) Patent No.: US 6,877,681 B2
(45) Date of Patent: Apr. 12, 2005

(54) SPRAY GUN HAVING IMPROVED FLUID TIP WITH CONDUCTIVE PATH

(75) Inventors: Ronald J. Hartle, Amherst, OH (US); David L. Mancini, Westlake, OH (US); George C. Ehrnschwender, Amherst, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/238,253

(22) Filed: Sep. 10, 2002

(65) Prior Publication Data

US 2003/0006322 A1 Jan. 9, 2003

Related U.S. Application Data

(63) Continuation of application No. 09/521,746, filed on Mar. 9, 2000, now Pat. No. 6,460,787, which is a continuation-in-part of application No. 09/177,213, filed on Nov. 22, 1998, now abandoned.

(51) Int. Cl.[7] ..... B05B 5/00
(52) U.S. Cl. ..... 239/691; 239/705; 239/708
(58) Field of Search ..... 239/690–708

(56) References Cited

U.S. PATENT DOCUMENTS

| | | | | |
|---|---|---|---|---|
| 3,008,645 A | | 11/1961 | Morel et al. | |
| 3,317,138 A | * | 5/1967 | Fraser | 239/697 |
| 3,747,850 A | | 7/1973 | Hastings et al. | |
| 3,843,052 A | | 10/1974 | Cowan | |
| 3,938,739 A | * | 2/1976 | Bertilsson et al. | 239/705 |
| 3,938,740 A | * | 2/1976 | Bertilsson et al. | 239/707 |
| 4,005,824 A | | 2/1977 | Becker et al. | |
| 4,182,490 A | | 1/1980 | Kennon | |
| 4,290,091 A | | 9/1981 | Malcolm | |
| 4,294,411 A | | 10/1981 | Hastings | |
| 4,361,283 A | | 11/1982 | Hetherington et al. | |
| 4,441,656 A | | 4/1984 | Huber | |
| 4,508,276 A | | 4/1985 | Malcolm | |
| 4,544,100 A | | 10/1985 | Simashkevich | |

(Continued)

FOREIGN PATENT DOCUMENTS

| | | |
|---|---|---|
| EP | 0477088 A2 | 3/1992 |
| EP | 0775528 A2 | 5/1997 |
| WO | WO 0023196 | 4/2000 |

OTHER PUBLICATIONS

Ronen Harari and Eran Sher "Optimization of a Plain–Jet Airblast Atomizer," Atomization and Sprays, vol., 7, pp. 97–113,1997.

*Primary Examiner*—Dinh Q. Nguyen
(74) *Attorney, Agent, or Firm*—Calfee, Halter & Griswold LLP

(57) ABSTRACT

A modular spray gun that can be configured and built to operate using a selectable spray process. The modular spray gun includes a gun body, an extension and a selectable spray atomizing component. The basic gun body and extension are used to configure a spray gun that can operate as an air spray gun, an airless spray gun, an AAA gun or an HVLP spray gun. The modular extension can be selected to allow circulating or non-circulating operation. The modular extension also permits a variety of spray nozzle assemblies to be mounted thereon depending on the selected spray process to be used with the specific gun. The modular gun body allows selective connection of an atomizing air supply and additional components specific to a particular spray process. An indicator device and/or a relief valve is provided for spray guns using an HVLP spray process to provide an indication that the spray gun is in compliance with the maximum nozzle air pressure limit, usually less than 10 psi. A new air valve seal assembly is also provided. The modular gun design can accommodate electrostatic and non-electrostatic versions.

10 Claims, 21 Drawing Sheets

U.S. PATENT DOCUMENTS

| | | | | | |
|---|---|---|---|---|---|
| 4,572,438 | A | | 2/1986 | Traylor | |
| 4,598,871 | A | | 7/1986 | Hartle | |
| 4,572,438 | A | | 2/1986 | Traylor | |
| 4,598,871 | A | | 7/1986 | Hartle | |
| 4,611,762 | A | | 9/1986 | Turner et al. | |
| 4,650,119 | A | | 3/1987 | Pomponi, Jr. | |
| 4,702,420 | A | | 10/1987 | Rath | |
| 5,056,720 | A | | 10/1991 | Crum et al. | |
| 5,135,172 | A | | 8/1992 | Toth | |
| 5,183,322 | A | | 2/1993 | Haruch | |
| 5,190,219 | A | | 3/1993 | Copp, Jr. | |
| 5,279,461 | A | | 1/1994 | Darroch | |
| 5,370,315 | A | | 12/1994 | Del Gaone | |
| 5,409,162 | A | * | 4/1995 | Sickles | 239/690.1 |
| 5,503,880 | A | | 4/1996 | Matschke | |
| 5,685,482 | A | | 11/1997 | Sickles | |
| 5,720,437 | A | | 2/1998 | Wu | |
| 5,765,761 | A | * | 6/1998 | Law et al. | 239/690.1 |
| 6,056,215 | A | * | 5/2000 | Hansinger et al. | 239/703 |

* cited by examiner

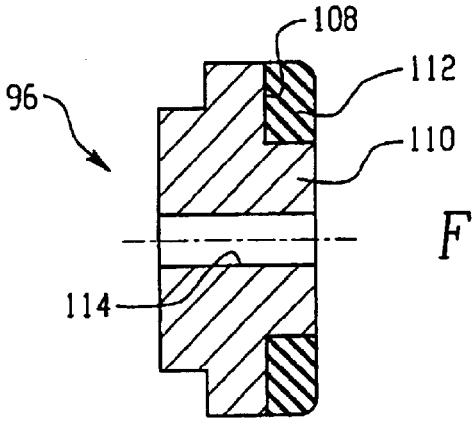
Fig. 6
Fig. 7
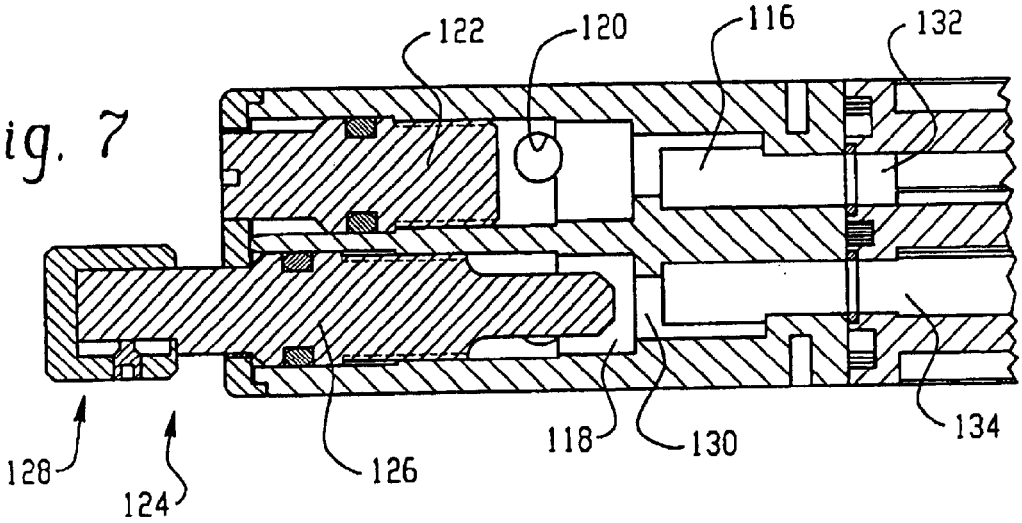
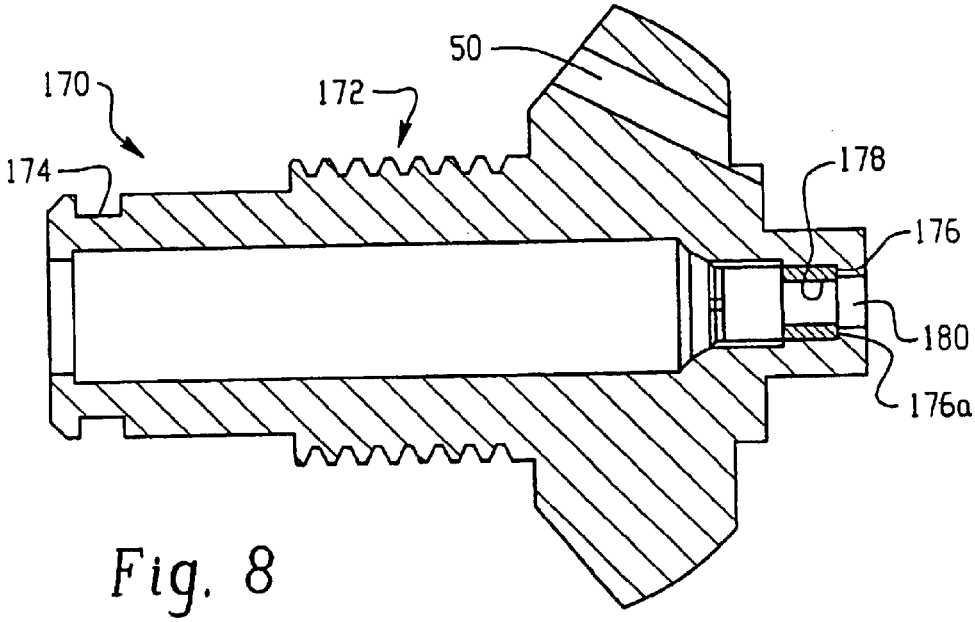
Fig. 8

SPRAY GUN HAVING IMPROVED FLUID TIP WITH CONDUCTIVE PATH

RELATED APPLICATIONS

This application is a Continuation of U.S. patent application Ser. No. 09/521,746 filed on Mar. 9, 2000 for MODULAR FLUID SPRAY GUN, now U.S. Pat. No. 6,460,787, which is a Continuation-in-Part of U.S. patent application Ser. No. 09/177,213 (abandoned) filed on Oct. 22, 1998 for MODULAR FLUID SPRAY GUN; the entire disclosures of which are fully incorporated herein by reference.

TECHNICAL FIELD OF THE INVENTION

The present invention relates to fluid spray guns. More particularly, the invention provides a modular design for a fluid spray gun which permits the gun to be configured to operate with a selectable spray process such as airless, air assisted airless, air spray and HVLP, with significantly reduced inventory requirements and minimal parts changes and assembly labor. The gun is provided in an electrostatic and non-electrostatic version.

BACKGROUND OF THE INVENTION

Fluid spray guns are generally known and are commonly used to spray a wide variety of fluids on any number of different types of articles. Spray guns can be used, for example, to spray fluids such as paint, lacquer, cleansers, sealants and so forth. Fluid spray guns may be hand operated or automatic depending on the specific application system requirements.

Fluid spray technology includes a number of spraying modes or spraying processes for applying a fluid to an object. A fundamental characteristic of all spray processes is that the fluid is atomized before it is applied to the object being sprayed. The spray processes differ in the manner by which the fluid is atomized, with the goal being a finely atomized spray that is released from the spray gun in a well defined spray pattern. The spray pattern can be shaped by the selected atomization process as well as by the design of the spray nozzle used with the spray gun. Thus, different spray technologies not only use different atomization processes but also may use different nozzle designs.

A familiar spray process is air spraying which utilizes pressurized air to atomize the fluid at the region of the spray nozzle outlet. Air spray guns thus tend to be operated at lower fluid pressures such that in the absence of an atomizing air supply the fluid simply runs out the nozzle as a small stream. The atomizing air is usually on the order of 10 to 100 psi. Therefore, the spray gun must be able to withstand such air pressures.

In some cases it is desirable or required to operate air spray guns at a reduced air pressure. Using lower atomizing air pressure may in some cases reduce fluid bounce back from the object being sprayed and thus increase transfer efficiency. Such spraying systems are generally referred to as using a high volume low pressure ("HVLP" hereinafter) spray process. In a typical HVLP process, the air pressure at the nozzle is kept to less than 10 psi but the spray nozzle is designed to increase the volume of air directed at the fluid spray. Thus, HVLP is a variation of air spray technology but utilizes a different spray nozzle design. Spray guns for HVLP operation also require a mechanism by which the air pressure at the nozzle can be tested for compliance with the under 10 psi requirement.

In both air spray and HVLP spray processes, the atomization air may not fully atomize the fluid or may produce an undesired spray pattern. Air spray guns therefore also utilize horn air. Horn air is a second source of pressurized air that is applied to an outer region of the atomized fluid spray pattern to shape the spray pattern and also to improve atomization of the fluid in the outer regions of the spray pattern.

Another fluid spray process is airless spraying. As suggested by the name, an airless spray process does not use high pressure air for primary atomization of the fluid. Rather, the fluid is supplied under high pressure to a small orifice in the spray nozzle. The kinetic energy applied to the liquid as it passes through the orifice breaks apart the fluid stream into a finely atomized spray, much like a garden hose nozzle produces a spray of water. In airless spray apparatus the fluid may be pressurized up to 1500 psi or higher although many airless spray guns operate at lower fluid pressures, for example 900–1000 psi. An airless spray nozzle is therefore different from an air spray nozzle in order to effect a desired spray pattern and adequate atomization.

Airless spray guns sometimes produce an effect generally known as tailing in which the fluid near the outer region of the spray pattern is not atomized to the same extent as in the center region of the pattern. This effect can reduce the overall quality of the finished product. In order to eliminate tailing and to further improve the atomization process, an air assisted airless ("AAA" hereinafter) spray process may be used. In such a process, although primary atomization occurs due to high pressure fluid passing through the nozzle orifice, atomization air may also be supplied and directed at the spray pattern in the region of the nozzle outlet.

Because each of the above described spraying processes utilizes different atomization and nozzle designs, it is not surprising that known spray guns usually only operate with a single spray process. Thus, there are airless spray guns, air spray guns, AAA guns and HVLP guns. For example, an airless spray gun does not have the hardware needed for air spray operation. An air spray gun typically will not operate as an airless gun. An air assisted airless gun will have air supplied to it, but typically will not operate satisfactorily as a true air spray gun.

Because these guns all use different spray technologies and nozzle designs, a spray gun manufacturer must keep a significant inventory of parts to build each gun type. Spray gun users may also need to keep a variety of spare parts to repair such guns.

Another spray technology is corona discharge electrostatic spraying in which an electrostatic charge is applied to the fluid as it is dispersed out the nozzle. The electrostatic charge helps to atomize the fluid, but more importantly is used to improve the transfer efficiency by utilizing the electrostatic attraction between the charged fluid and the object being sprayed. Electrostatic guns thus can utilize air spray technology such as air assisted and airless air assisted and HVLP. Accordingly, known electrostatic gun designs include the same problems of numerous parts, different gun designs for each technology and so forth as described hereinabove.

It is desired therefore to provide a new spray gun apparatus that can utilize a number of different fluid spray technologies using basic shared components that can be easily configured for a specific application.

SUMMARY OF THE INVENTION

To the accomplishment of the foregoing objectives, and in accordance with one embodiment of the invention, a significantly different approach is taken for designing a fluid spray gun by providing a spray gun that is modular so that the spray gun can be configured and built to operate using a selectable spray process. In one embodiment, a modular spray gun includes a gun body, an extension and a selectable atomizing component. The basic gun body and extension are used to configure a spray gun that can operate as an air spray gun, an airless spray gun, an AAA gun or an HVLP spray gun as well as an electrostatic spray gun using air, airless, air assisted or HVLP technologies. The modular extension can be selected to allow circulating or non-circulating operation. The modular extension also permits a variety of atomizing components to be mounted thereon depending on the selected spray process to be used with the specific gun. In an electrostatic version, the modular extension may house the high voltage multiplier.

The modular gun body allows selective connection of an atomizing air supply and additional components for air management specific to a particular spray process. In one embodiment the modular gun body and air management components allow separate air adjustment control for horn air and atomizing air depending on the selected spray technology.

In accordance with another aspect of the invention, an indicator device is provided for spray guns using an HVLP spray process to provide an indication that the spray gun is in compliance with the maximum nozzle air pressure limit of less than 10 psi.

In accordance with yet another aspect of the invention, a new air valve design is provided that can be used with the modular air spray guns described herein or with other devices that use air valves.

Still another aspect of the invention provides an atomizing component that enhances the modular features of the present invention in that there is provided a fluid flow element having a nozzle orifice therein, with the element being made of a lightweight non-metallic material such as plastic, for example, and includes a hard insert that is placed in the orifice. In a preferred embodiment the insert is made of carbide and is press fit into the orifice. The carbide insert thus allows a modular gun to be configured as an airless spray gun or as an air assisted airless spray gun by selecting the appropriate fluid flow element within a modular atomizing component. In accordance with a further aspect of the invention, an atomizing component or device is provided with significantly improved atomization for HVLP and air spray configured guns.

In accordance with a further aspect of the invention, a fluid tip and air cap arrangement is provided that optimizes atomization using a conical tip contour and a small flat area at the nozzle orifice. In the preferred embodiment the cone half angle is thirty degrees.

In accordance with other aspects of the invention related to the electrostatic technologies, a modular extension is used that houses a high voltage multiplier having a multi-step weight distribution. This positions most of the multiplier weight over the handle to reduce operator fatigue. In accordance with another aspect of the invention, an atomizing component includes an electric circuit path for an electrode, either molded with a fluid tip in the case of a high pressure gun or molded into a needle valve in the case of a low pressure gun. This greatly enhances the modularity and ease of use of the gun for assembly, repair and maintenance. Still a further aspect of the electrostatic version is a dynamic electrostatic seal that isolates the high voltage charge material from ground at the gun body to prevent discharge. Still a further aspect of the invention provides for an air cooled heat sink for the high voltage multiplier.

These and other aspects and advantages of the present invention will be apparent to those skilled in the art from the following description of the preferred embodiments in view of the accompanying drawings.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein:

FIG. 6 is an enlarged view of an air valve piston in accordance with one aspect of the invention;

FIG. 7 is a partial top view in section of the spray gun in FIG. 5 taken along the line 7—7;

FIG. 8 is a cross-section of a fluid tip suitable for use with a modular spray gun configured to operate as an airless spray gun;

DETAILED DESCRIPTION OF THE PREFERRED EMBODIMENTS

Figure 1:
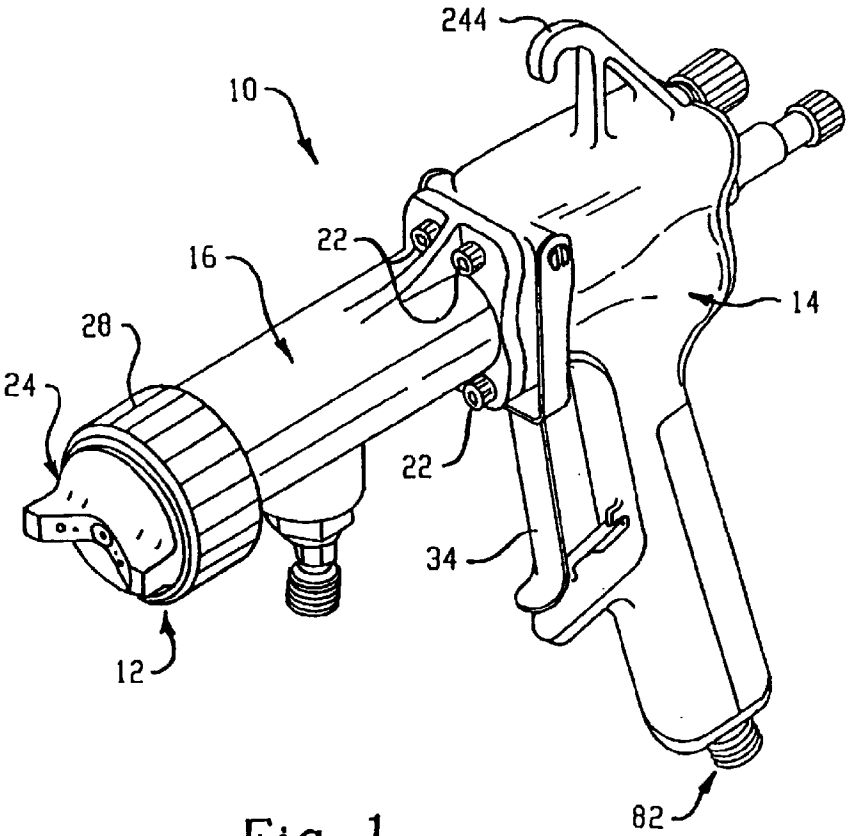
FIG. 1 is a perspective illustration of an exemplary embodiment of a modular spray gun in accordance with the invention, in this example the gun being configured as an air spray gun.

With reference to FIG. 1, the present invention contemplates a modular spray gun 10 that can be easily configured to operate with a selectable spraying process. The invention contemplates a modular spray gun design whereby the gun can operate as an air spray gun, an airless spray gun, an air assisted airless (AAA) spray gun or an HVLP spray gun. These processes are intended to be exemplary in nature in that other spray processes may be available for incorporation into the modular gun concept, for example, an electrostatic spray process. In general, it is within the scope of the present invention to provide a modular spray gun design that can be configured to operate as an airless gun and as an air spray gun. Those skilled in the art will appreciate, for example, that a AAA spraying process is a variation of an airless spray process, and that an HVLP process is a variation of an air spray process. Thus, other variations in these spray processes and the incorporation of other spray processes such as electrostatics are considered to be within the scope of the present invention.

FIG. 1 illustrates an embodiment of a manual non-circulating air spray gun 10 that is fully assembled but not connected to a fluid supply or an air supply. The basic elements of the modular gun 10 are an atomizing component 12, a gun body 14 and an extension body 16 which interconnects the gun body 14 to the atomizing component assembly 12. Those of ordinary skill in the art will appreciate that although the atomizing assembly 12 is referred to herein as a "component", there are a number of parts that make up the atomizing component. Although the exemplary embodiments herein illustrate the extension 16 and the body 14 as two separate pieces, it is also contemplated that in some applications it may be desired to have the extension 16 and gun body 14 combined as a single piece. Having a single gun body and extension unit would reduce modularity and be a more complicated part to manufacture and therefore is considered less preferred than the illustrated embodiments, however, such an arrangement would still be able to take advantage of the general modular design concepts to provide a spray gun that could be configured to operate with a selectable spray technology.

The atomizing component 12 includes various components including a nozzle that are used to control or shape the fluid spray released from the gun 10, as will be described in detail hereinafter. The gun body 14 includes air management features that facilitate the configuration of a gun for a particular spraying process. The air management features include, within the gun body 14, a number of passages for atomizing air and horn air when required in a selected air spraying or air assisted spraying process, and also selectable air management components for setting up or configuring the gun in one of the selectable spraying modes, as will be further described herein. In manual guns, the gun body 14 includes a handle for gripping and holding the gun during operation. In an automatic gun, the gun body 14 includes a control block (such as for a piston control, for example) that can be mounted on a robot arm or other apparatus that controls position of the gun during a spraying operation. Finally, the extension body 16 provides a fluid passage for feeding fluid to the atomizing component 12, and also provides internal atomizing air and horn air passages connected to corresponding passages in the gun body 14, as well as access for selecting the appropriate trigger control devices based on the selected spraying mode for a particular gun.

The basic modular components include the atomizing component 12, the gun body 14 (including the air management components when required) and the extension 16. These components permit a spray gun to be configured by simply selecting and installing the appropriate atomization component, trigger control and air management components as required. It is contemplated that the gun body 14 and the extension 16 as well as some parts of the atomizing component 12 and the air management parts be interchangeable modular parts that can be used with all of the available spray gun 10 configurations. This greatly reduces the number of parts that must be inventoried for building and/or repairing spray guns such as air spray, AAA, HVLP and airless models.

Figure 2:
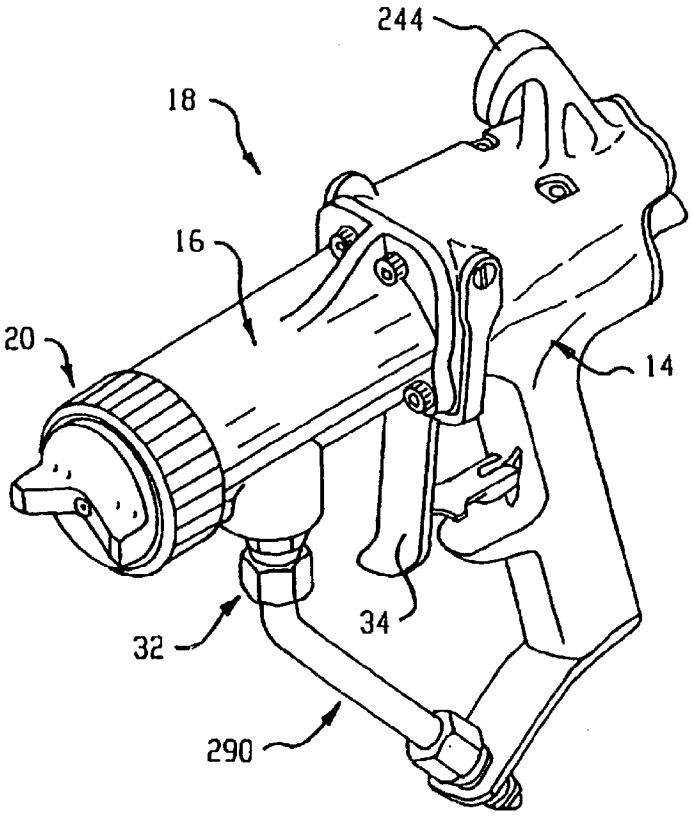
FIG. 2 is a perspective illustration of an exemplary embodiment of a modular spray gun in accordance with the invention but configured as an airless spray gun.

By way of example of the modular nature of the basic gun components, FIG. 2 illustrates an embodiment of a manual non-circulating airless spray gun 18. The airless gun 18 is illustrated fully assembled but not connected to a fluid supply. In comparing FIGS. 1 and 2 it will be readily noted that the same gun body 14 and extension body 16 are used, albeit differently configured with various accessory parts as will be described herein. The atomizing component 20 for the airless gun 18 is different in some respects from the atomizing component 12 used with the air spray gun 10, however, both atomizing component assemblies are still modular in nature because they can be connected to the same extension body 16 design.

Figure 3:
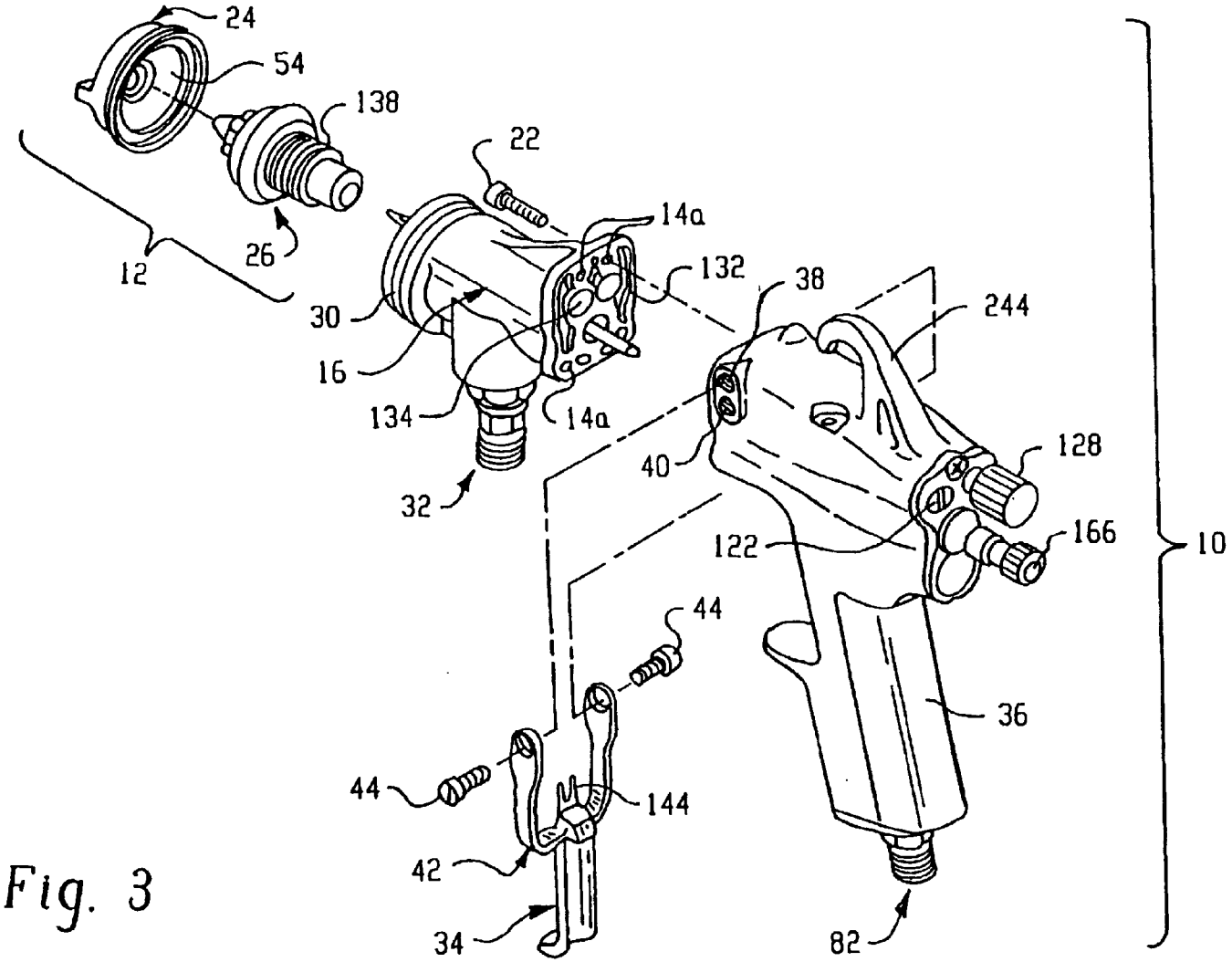
FIG. 3 is a partially exploded rearward view of the spray gun of FIG. 1.

FIG. 3 shows the manual air spray gun 10 in an exploded rearward view of its basic modular components. The extension 16 and the gun body 14 can be interconnected by the use of standard mounting screws 22 that are passed through the corresponding bolt holes 14*a* in the extension 16 and attached to the gun body 14 (also see FIG. 1). The atomizing component 12 includes an air cap 24 and a fluid tip 26 as will be further described herein. A threaded retaining ring 28 (FIG. 1) is used to securely hold the atomizing component 12 components on the forward threaded end 30 of the extension 16. In FIG. 3 the extension 16 is illustrated with a fluid fitting 32 installed for connection to a fluid supply line.

The modular spray gun 10 includes a trigger 34 that is used on manual guns to control operation of the gun 10. The gun body 14 also includes a downwardly extending handle 36 that permits the gun 10 to be hand-held during operation. When the trigger 34 is pressed rearward towards the handle 36, the trigger 34 causes an air valve (not shown in FIG. 3) to open and also retracts a needle valve (not shown in FIG. 3) to open a fluid orifice or nozzle in the atomizing component 12. In an air spray gun, such as illustrated in FIG. 3, the fluid to be sprayed is supplied to the gun at a relatively low pressure, and therefore the trigger 34 need not apply much retraction force to the needle valve. However, in an airless gun, the fluid to be sprayed is supplied under relatively higher pressure and so the trigger 34 must exert greater force to retract the nozzle valve element (in an airless gun nozzle a ball valve tip is used in place of a needle valve) and also possibly a shorter stroke depending on the specific nozzle design. Accordingly, the gun body 14 in this exemplary embodiment is provided with at least two sets of mounting holes 38, 40 located on opposite sides of the gun body 14 for mounting the trigger 34 to the gun body 14. The upper mounting holes 38 are used for air spray and HVLP guns and the like in which the fluid pressure to the atomizing component 12 is relatively low. The lower mounting holes 40 are used for guns that will have relatively high fluid pressures, such as for example an airless gun or a AAA gun. The trigger 34 includes a yolk 42 that is secured to either side of the gun body 14 by screws 44. Thus, the trigger 34 is one element of the modular gun that is configurable. Those skilled in the art will appreciate, however, that it may be possible to design a nozzle and trigger control for both high and low fluid pressure guns that can use the trigger 34 mounted in a single location on the gun body 14. The provision of selectable mounting holes simply increases the flexibility of the modular gun design.

Figure 4:
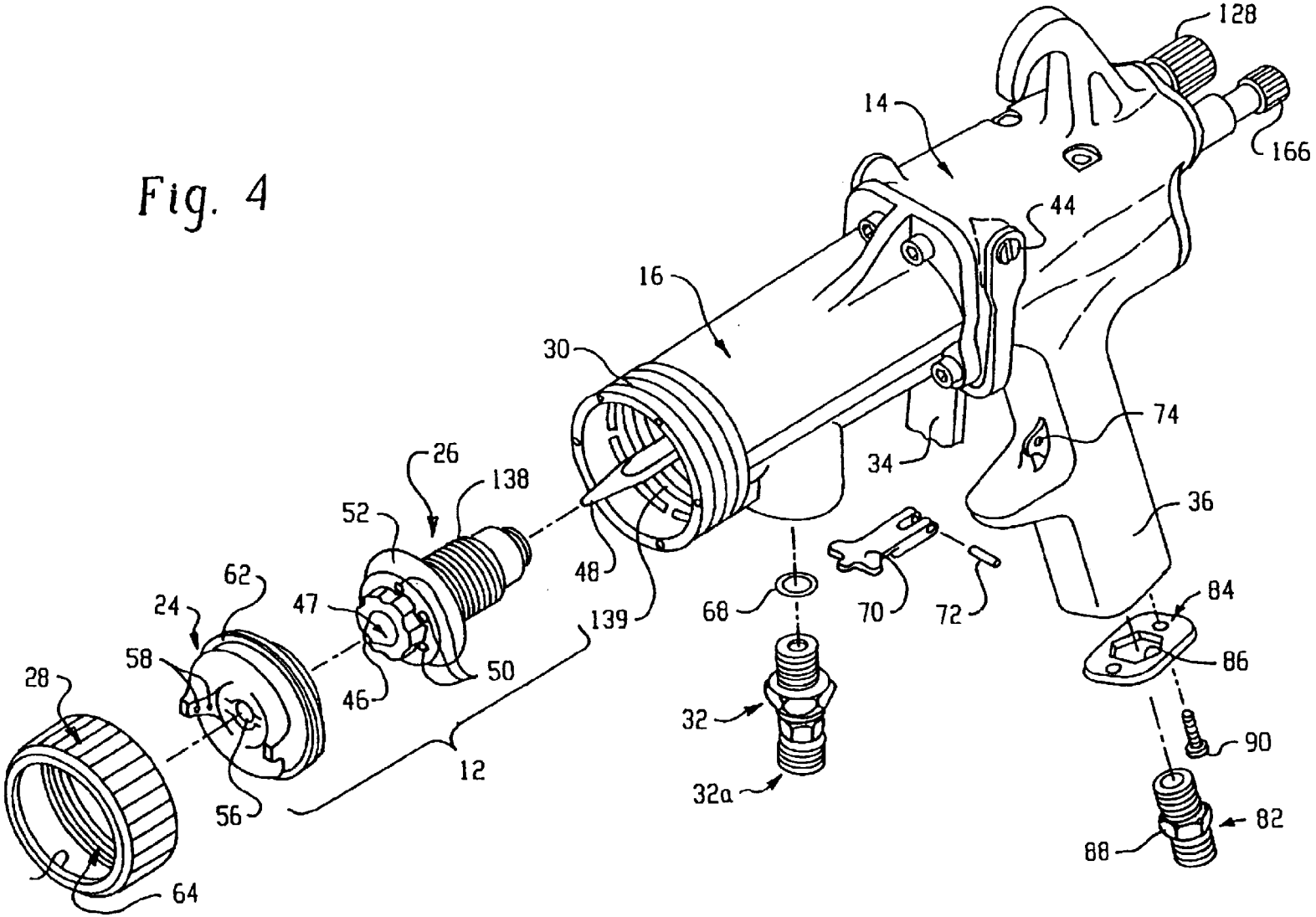
FIG. 4 is a partially exploded forward view of the spray gun of FIG. 1.
Figure 5:
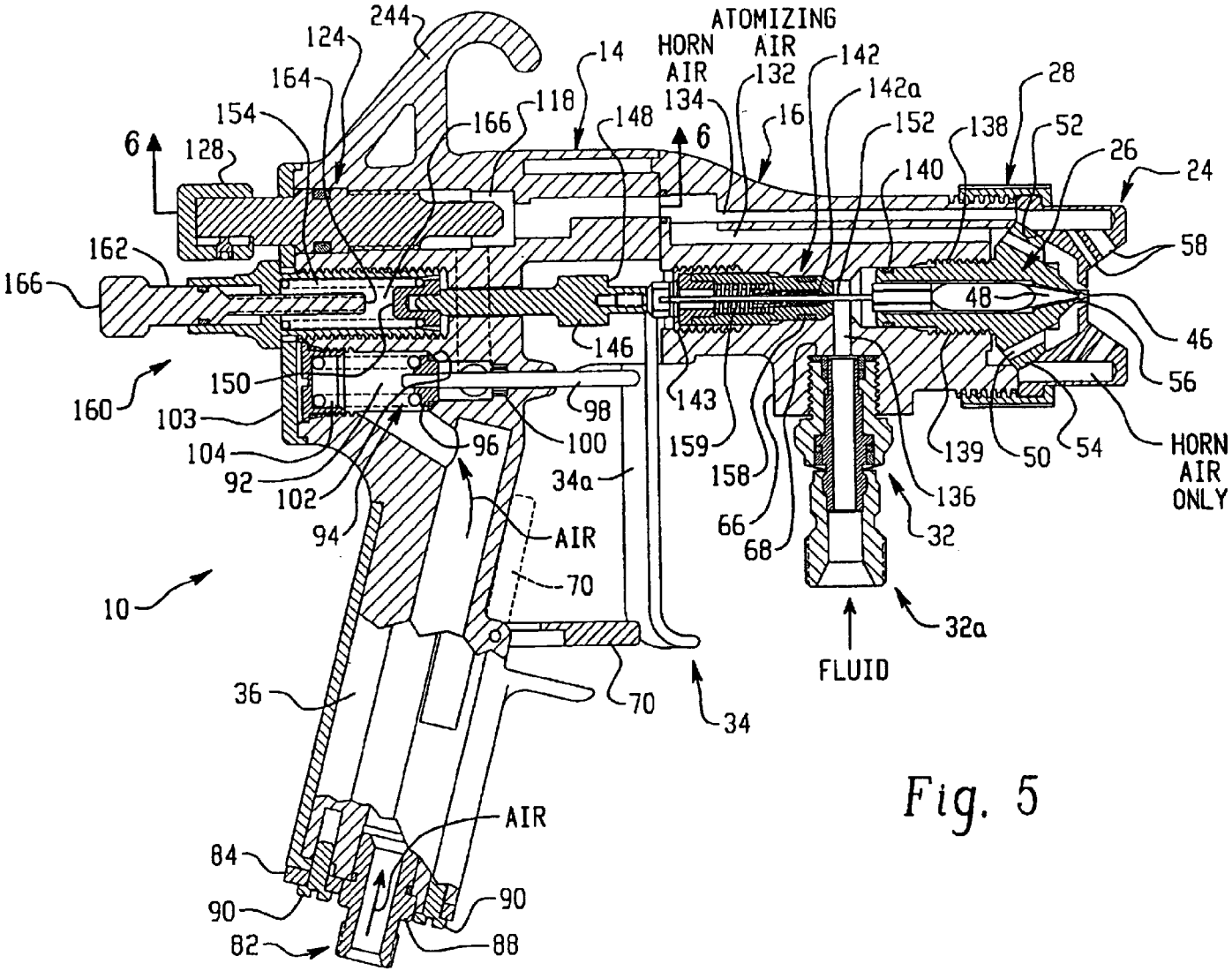
FIG. 5 illustrates the air spray gun of FIG. 1 in partial vertical cross-section.

FIGS. 4 and 5 illustrate additional features of the gun 10 design configured to operate as an air spray gun. The fluid tip 26 provides a centrally disposed orifice or nozzle 46 through which fluid is released in a spray pattern. A needle type valve 48 is used to open and close the orifice 46. The needle 48 is spring biased to a closed position and can be retracted to open the orifice 46 by operation of the trigger 34. In FIG. 4 the trigger 34 is only partly shown for clarity of other elements in the drawing. The fluid tip 26 is provided with air holes or jets 50 that are located rearward and surround the orifice 46. The fluid tip 26 may be, for example, part no 325571 available from Nordson Corporation, Amherst, Ohio.

The fluid tip 26 includes an annular tapered peripheral surface 52. The fluid tip 26 is sized to be inserted into the air cap 24. The air cap 24 is used to direct atomizing air from the air holes 50 in the fluid tip 26 into the stream of fluid as the fluid is discharged through the orifice 46. The air cap 24 includes an internal tapered surface 54 (FIG. 5) that cooperates with the tapered surface 52 of the fluid tip to force atomizing air forward and through an annular passageway 56 that surrounds the orifice 46 when the air cap 24 and the fluid tip 26 are assembled together (see FIGS. 5 and 5A). The air cap 24 can also be provided with additional air holes 54 which are used to direct horn air into the atomized fluid. Horn air is supplied to the air cap 24 from a horn air fluid passage within the extension 16. Horn air passes around the outside of the tapered surface 52 and into the outer periphery of the air cap 24 to the air holes 58. Thus, horn air and atomizing air do not mix within the atomizing component 12. Horn air and atomizing air are provided from a single supply air source external the gun but are separately routed within the gun, and this separation is accomplished back in the gun body 14 as will be described hereinafter. The extension 16 thus also includes separate horn air and atomizing air fluid passages (see FIG. 5) which are in fluid communication with their respective horn and atomizing air passages in the gun body when the gun is assembled. The horn air and atomizing air may alternatively be separately controlled.

The retaining ring 28 includes an inwardly extending flange 60 that engages an outer peripheral flange 62 (FIG. 4) on the air cap 24. The retaining ring 28 is internally threaded as at 64 for threaded engagement with the forward threaded end 30 of the extension 16. The retaining ring 28 thus securely holds the air cap 24 and the fluid tip 26 together on the extension 16.

Still referring to FIGS. 4 and 5, the extension 16 includes a fluid inlet boss 66 that in this case extends downward and is internally threaded to receive a threaded fluid inlet fitting 32. An o-ring face seal 68 can be used to provide a fluid tight connection between the fitting 32 and the extension 16. The fitting 32 receives at its opposite end 32*a* a fluid hose that is connected to a supply of fluid that is to be sprayed (not shown in FIG. 4).

A trigger lock 70 is pivotally joined to the handle 36 by a pin 72 that extends through the lock 70 and a hub 74. When the lock 70 is in the locked position illustrated in FIG. 5, it interferes with and prevents rearward movement or actuation of the trigger 34. The lock 70 can be flipped up as shown in phantom in FIG. 5 to release the trigger 34 thereby allowing an operator to manually actuate the gun 10.

With reference to FIG. 5, the modular gun body 14, and in this example the handle 36, is provided with an atomizing air inlet passage 80. The lower end of the handle 36 is adapted to retain an air hose fitting 82. The air fitting 82 is threaded into the lower end of the handle 36. A retainer bracket 84 includes a hex hole 86 (FIG. 4) that slips over a hex body 88 of the fitting 82. The bracket 84 is secured to the handle 36 by screws 90. When secured in place, the bracket prevents unintended loosening of the air fitting from the handle 36 by locking the hex 88 against rotation. When the gun body 14 is to be used as part of an airless gun, the air fitting 82 may be omitted and a solid bracket used to close off the handle 36 open end. The air fitting 82 arrangement is used for AAA and HVLP guns as well.

The atomizing air inlet passage 80 opens to an air valve chamber 92. An air valve 94 is realized in the form of a valve piston 96 mounted on a piston rod 98. The rod 98 extends out of the gun body 14 towards the rearward side 34*a* of the trigger 34. A suitable packing 100 seals the rod 98 to prevent substantial air loss around the rod 98. A valve seat 102 is formed in the gun body 14 and defines an outlet port 106. The piston 96 carries a valve seal that seats against the valve seat 102 to close the valve and block air flow through the gun body 14. A spring 104 biases the valve 94 to a closed position as shown in FIG. 5. When the trigger 34 is retracted, it pushes the rod 98 rearward which moves the piston 96 away from the outlet port 106.

FIG. 6 illustrates in an enlarged view the valve piston 96. The piston 96 includes a retaining surface 108 with an axial extension 110 thereof. An elastomeric seal 112 is retained on the valve piston 96 so that the seal 112 is pressed against the valve seat 102 when the valve 94 is closed. In accordance with one aspect of the invention, the seal 112 is positioned on the piston 96 before the seal material is cured. The seal 112 is then cured in situ and thereby becomes strongly bonded to the piston 96 retaining surface 108. As one example, the seal 112 may be Buna N rubber and cured using a conventional vulcanization process, with the mold being configured to hold the seal and the piston 96 in place. Other elastomers may be used for the seal. The piston 96 may be, for example, stainless steel or other suitable material. For convenience, the piston rod 98 can be press fit into the piston center bore 114 after the seal 112 is cured to simplify the mold configuration.

An air valve cap or plate 103 can be used to retain the valve assembly 94 inside the gun body 14.

With reference again to FIG. 5 and to FIG. 7, the air valve outlet port 106 is connected to first and second air adjust chambers 116, 118 via a conduit 120. The air adjust chambers 116, 118 are used as required for adjusting air flow depending on the particular configuration of the spray gun. Thus, in general, the air management function (for example, horn air, atomizing air and adjustments therefor) is realized in the use of the air valve and the air adjust chambers, including additional selectable components for the air adjust chambers as will be described herein which are used to configure the gun 10 for a particular spray process using an appropriate air management function. In the air spray gun of FIG. 5, atomizing air is provided by a regulated supply of air back at the air source (not shown). Therefore, supply air is provided through the air valve 94 as atomizing air that is fed to the first adjustment chamber 116 and this chamber is simply plugged with a threaded air tight plug 122 that is threadably inserted into the chamber 116. In place of the plug a pressure sensor or indicator could be provided. Of course, if desired an adjustment valve (similar to valve 124 described below) could be provided but this typically is not needed because atomizing air is regulated due to its high pressure.

In the air spray configuration, horn air is also typically used and in this case part of the supply air is fed into the second air adjust chamber 118 and is used as horn air. Since horn air is typically used to adjust the fluid spray pattern, there is occasionally the need to want to adjust the volume of horn air flowing to the atomizing component 12. Therefore, an air adjustment valve 124 is provided in the second chamber 118. The adjustment valve 124 is simply a threaded valve element 126 that extends through the chamber 118 and out the back end of the gun body 14. A knob 128 is provided so that an operator can adjust the flow of air through the chamber 118. The valve element 126 extends towards a port 130. In this embodiment, the valve element 126 is threadably mounted in the chamber 118. As the knob 128 is rotated, the valve element 126 adjusts the amount of air flowing through the chamber 118 to the atomizing component 12. Note that the valve element 126 can be fully moved to shut off air flow through the chamber 118 by seating against the port 130. In this manner the operator can control and shut off horn air supplied to the atomizing component 12.

It is noted at this time that for an airless gun configuration the adjustment valve 124 can be removed or not used and a second plug used in the second chamber 118. For AAA guns which use atomizing air and usually not horn air, the adjustment valve 118 and the plug 122 are switched in position so that the horn air chamber 118 is plugged and the adjustment valve 124 can be used to adjust the atomizing air for the AAA configuration.

Figure 7A:
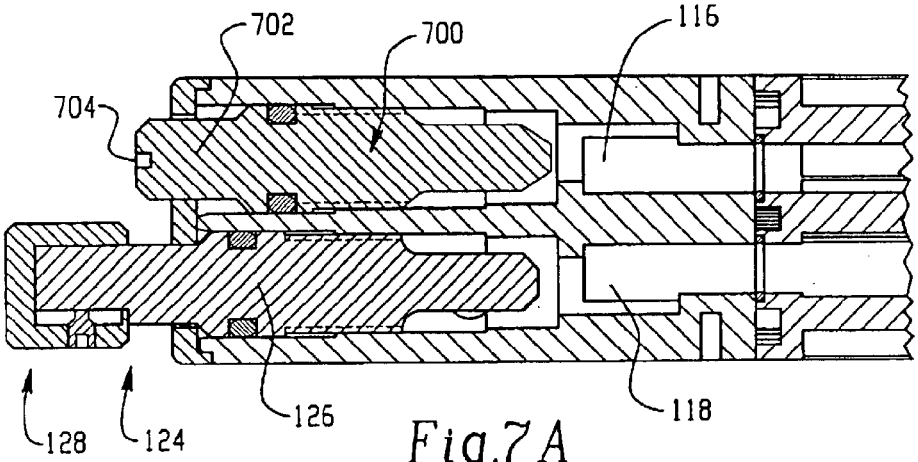
FIG. 7A is an alternative embodiment for the HVLP configuration of FIG. 7 using an atomizing air adjustment valve.

An HVLP gun typically will use the configuration of FIG. 7 since it uses horn air. In some HVLP spray applications we have found that by increasing horn air a significantly higher control over the fan pattern can be achieved. In order to accomplish this increased flow of horn air, the plug 122 of FIG. 7 (which is the atomizing passage 116 plug) may be replaced with an adjustment or regulation valve 700, such as, for example, a valve similar to the adjustable plug 122 of FIG. 10. Note that in the embodiment of FIG. 10 the element 122 is simply used to block horn air. It may be used, however, as an adjustable air valve, in that it is threadably adjusted in the passage and includes a screwdriver slot that an operator can access for adjusting the air flow. Thus, as shown in FIG. 7A, when such an adjustable valve 700 is used in place of the plug 122 in FIG. 7, the atomizing air can be adjusted relative to the horn air. In this example, the valve 700 is threadably received in the atomizing air chamber 116, and includes a back end 702 that is accessible to the gun operator. A screwdriver slot 704 is provided to allow the operator to adjust the axial position of the valve 700 within the chamber 116 to adjust atomizing air flow independently of the horn air adjustment valve 126. The screwdriver slot 704 is used in place of an adjustment knob to more easily distinguish the horn air and atomizing air adjustment valves to the operator. Many other adjustment techniques may be used for either valve. We have found that particularly in HVLP applications, reducing atomizing air increases horn air sufficiently to significantly increase fan pattern control. Fan pattern width control from about 4 inches up to about 20 inches can be easily achieved by incorporating the atomizing air adjustment valve into the atomizing air passage 116 in FIG. 7. As the horn air is increased by decreasing atomizing air, the fan pattern oval diameter is elongated along the major axis and narrows somewhat along the minor axis.

Thus, the gun body 14 can be easily configured to accommodate airless and air spray and AAA configurations including horn air and atomizing air adjustments using the same basic modular body 14 but selecting which air management components to control the air flow for a selected spraying process.

The first adjustment chamber 116 extends through an upper portion of the gun body 14 and connects to an atomizing air passage 132 that runs through the extension 16 to the atomizing component 12. Similarly, the second adjustment chamber 118 extends through an upper portion of the gun body 14 and connects to a horn air passage 134 that runs through the extension 16 to the atomizing component 12. The horn air passage 134 and the atomizing air passage 132 are isolated from one another through the extension 16. FIG. 5 has been drawn to illustrate all the flow passages in a single view for ease of explanation and understanding, but those skilled in the art will appreciate that the passages 132 and 134 would not necessarily be viewed in a single vertical cross-section through the extension 16. The horn air and atomizing air passages in the gun body 14 are coupled to the corresponding passages in the extension 16 when the gun body 14 and extension 16 are secured together by the screws 22.

As noted herein above, fluid is supplied to the extension 16 via an inlet boss 66 that retains a suitable fluid inlet fitting 32. The fitting 32 feeds fluid into a fluid chamber 136 which is threaded at a forward end 139 to receive a threaded end 138 of the fluid tip 26. An o-ring 140 is used to provide a fluid tight connection. By this arrangement fluid that is to be sprayed is fed into the fluid tip 26 to the nozzle orifice 46.

As described with respect to FIG. 4, a needle valve in the form of a needle 48 is used to open and close the orifice 46. Operation of the needle valve 48 is controlled by the trigger 34 via a packing cartridge assembly 142 and a puller 146. The trigger 34 includes at its upper end a connection yolk 144 (FIG. 3) that interfaces a puller 146. The puller 146 is supported in the gun body 14 and includes an adjustment cap 150 at a distal end thereof. The forward end of the puller 146 is secured to a wire 152 that is also secured to the needle 48. The wire 152 extends through the packing cartridge 142 body and sealed by a packing 142*a*. The puller 146 is biased by a spring 154 so as to have the needle 48 close the orifice 46. When the trigger 34 is retracted by the operator, it first engages the air valve stem 98 and then engages a shoulder 148 on the puller 146. This delay assures that the air valve is opened before fluid flows to the atomizing component 12. The trigger 34 thus moves the puller 146 away from the atomizing component 12 thus retracting the needle 48 from blocking the orifice 46. Fluid thus flows through the fluid tip 26 around the needle 48 to the orifice 46 and is atomized by the high pressure air.

The packing cartridge 142 is received in a bushing 143 that is threadably retained in a bore 156 within the extension 16. This bushing 143 retains the cartridge 142 in the extension 16. The cartridge 142 includes appropriate seals 158 to prevent fluid from flowing back toward the gun body 14. A spring 159 is provided to urge the cartridge sealing element 142*a* forward to maintain a good seal against fluid leakage.

In some cases it is desired to have a fluid flow adjustment function for the air spray gun 10. This is provided in the exemplary embodiment by a fluid flow adjustment mechanism 160. The fluid flow adjustment mechanism 160 includes a threaded needle 162 having a forward end 164 that extends into a bore 166 in the gun body 14. The threaded needle 162 has an opposite end that extends outside the gun body 14 and has an adjustment knob 166 thereon. The operator can turn the knob 166 and thereby adjust the position of the needle end 164 relative to the puller cap 150. The needle end 164 thus functions as a stop that limits the stroke of the puller thereby limiting how far the needle valve 48 can be opened. In this manner the flow rate of the fluid through the orifice 46 can be adjusted.

The trigger 34 operates so as to open the air valve 94 before the fluid atomizing component 12 is opened. This avoids spitting and non-atomized fluid from being discharged through the orifice 46. This can be accomplished easily by providing a small amount of lost motion on the puller 146 until the air valve 94 opens, as described hereinabove. In the described embodiment this lost motion is realized in the distance the trigger 34 travels between first engaging the air valve stem and then engaging the shoulder 148 of the packing cartridge.

Having described an embodiment of an air spray configured spray gun 10, the same gun can be used for HVLP operation. The only changes that are required would be to select an appropriate atomizing component 12. An HVLP atomizing component will be very similar to the components described herein for the air spray configuration, but the air cap 24 and the fluid tip 26 are modified to increase the volume of air, thereby also reducing the pressure of the atomizing air and the horn air to less than 10 psi. This can be accomplished, for example, by increasing the number and size of the air holes 50, 58.

For air spray and particularly for HVLP type guns, the fluid tip 26 includes a conical tip 47 having the nozzle orifice 46 formed therein (also see FIG. 4). The cone half angle is preferably selected at thirty degrees. This angle produces optimum uniformity in the spray pattern, and reference is made to "Optimization Of A Plain Jet Atomizer", Harari & Sher, Journal of Atomization and Sprays, vol. 7, pp. 97–113, 1997, the entire disclosure of which is fully incorporated herein by reference.

Figure 5A:
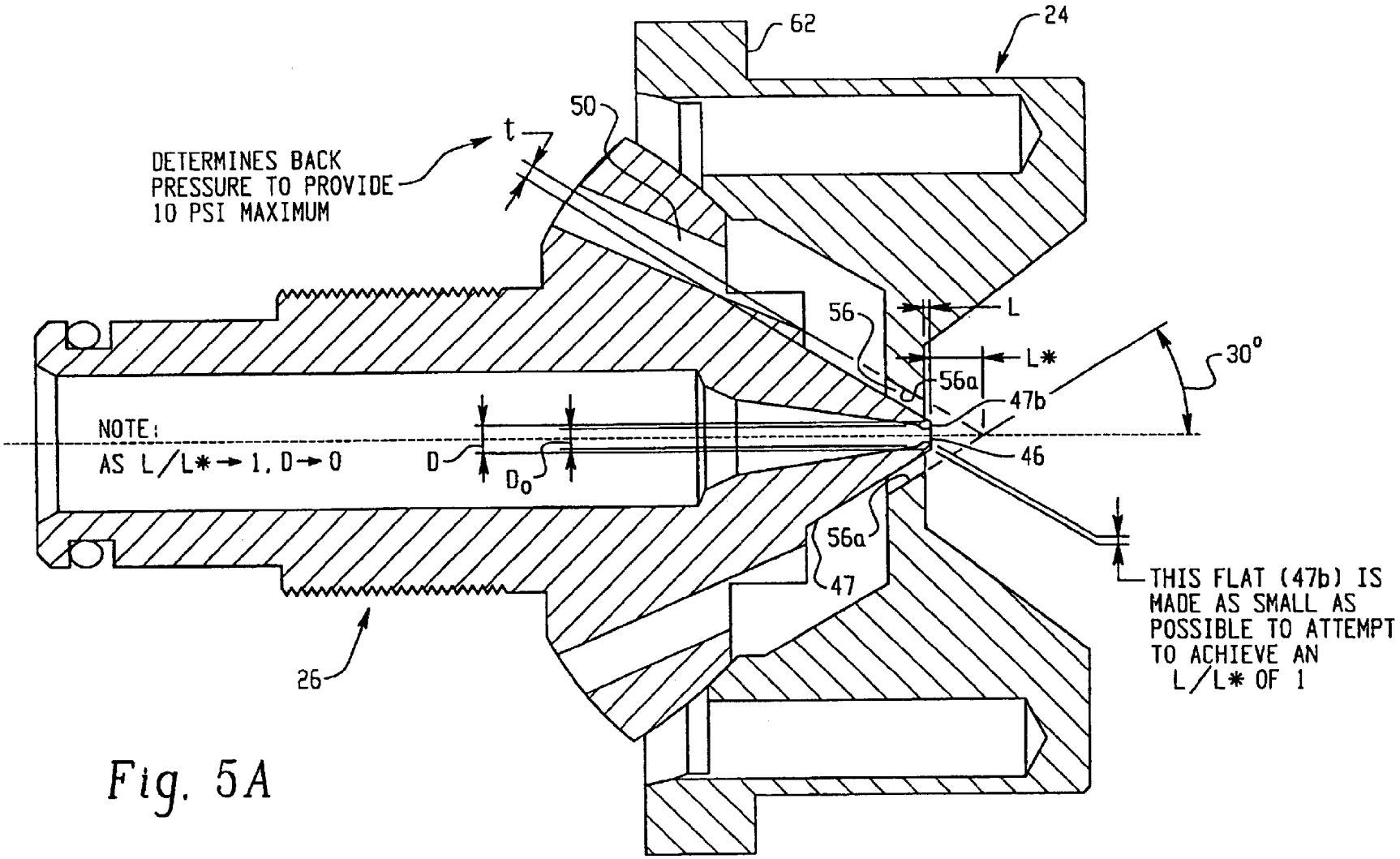
FIG. 5A illustrates an enlarged view of a fluid tip and air cap in accordance with the invention.

With reference to FIG. 5A, those of ordinary skill in the art will appreciate that different cone angles could be used, however. It is further preferred though not essential that the nominal outside diameter "D" of the fluid tip cone 47 at the nozzle orifice 46 be only slightly larger than the tip 47 inside diameter "$D_O$" at the orifice 46, for example only 0.001 inches. This minimizes the size of the flat tip truncated end 47*b* at the orifice 46 thus significantly improving atomization. Thus, the ideal ratio of $D_O/D$ is 1. This ratio is not practical in manufacturing so D is maintained as $D_O$+0.001, for example. This results in immediate impingement of the atomizing air on the fluid stream.

FIG. 5A illustrates an enlarged view of an exemplary HVLP and/or air spray fluid tip 26 and air cap 24 arrangement. FIG. 5A shows that the air jets 50 feed atomizing air around the conical tip 47 to the annulus 56. The annulus 56 is formed between the conical tip 47 end and a frusto-conical surface 56*a* in the air cap 24. It is preferred though not essential that the air cap 24 maintain the same thirty degree angle about the annulus 56 such that the dimension "t" noted on FIG. 5A is constant.

The tip 47 also is designed to extend past the face plane of the air cap 24 in the region of the annulus 54 a small amount "L", for example, 0.020 inches. With the orifice 46 positioned slightly downstream of the annulus 56 by this distance L, the atomizing air impinges on the fluid stream from the orifice 46 a distance L* where L* is located at the apex of the cone 47 if the cone were not truncated. The orifice 46 is formed in the flat face 47*b* of the tip 47. It is preferred to achieve a ratio L/L* of 0 if a minimum SMD (Sauter Mean Diameter) and as a result, a finer spray, is desired. A ratio of L/L*=1 is desirable for a more uniform distribution of spray droplets. This design generates better drop uniformity for smaller fluid tips, i.e. lower fluid flow rates, which atomize more easily, and minimum drop size for the larger fluid tips, i.e. higher flow rates. The ratio L/L* approaches 0 as the dimension L approaches 0; however, a minimum L is needed to prevent back pressure on the fluid stream. The ratio L/L* approaches 1 as L approaches L*.

As noted herein with reference to FIG. 2, a modular spray gun configured to operate as an airless spray gun in accordance with the invention uses many of the same parts as are used with the air spray and HVLP guns of FIGS. 1 and 5. Specifically, an airless spray gun can use the same extension 16, the same gun body 14 and the same trigger 34 and retaining ring 28. With reference to FIG. 5, in order to configure the spray gun for airless operation, the air fitting 82 is removed or simply not installed, and a solid cover bracket 84' is used to close the handle 36 open end. Since air is not used in an airless gun, the adjustment chambers 116, 118 are not used and therefore can be plugged using two plugs similar to the plug 122. Finally, since the airless gun operates with higher fluid pressure into the atomizing component 12, the trigger 34 is mounted to the gun body 14 using the lower mounting holes 40 (see FIG. 3). The air valve 94 assembly can either be removed or not installed as it is not used and the cap 103 used to cover the air valve chamber 92.

An airless gun uses a different atomizing component 12 design also. Since air is not used to atomize the fluid, the fluid is forced through a small orifice and atomizes as it exits the orifice. Therefore, in order to configure the spray gun as an airless gun, the fluid tip must be designed for airless spraying. The retaining ring 28 can still be used, as can the air cap 24 although for an airless gun the air cap 24 does not provide a needed function.

FIG. 8 illustrates a fluid tip 170 suitable for use with an airless spray gun configuration. The basic profile of the tip 170 can be the same as the air spray fluid tip 26 and includes a threaded portion 172 that can be threaded into the extension 16 tip bore 139. A groove 174 is provided to retain the seal o-ring 140.

In accordance with another aspect of the invention, the airless fluid tip 170 is provided with a counterbore 176 that also forms the outlet orifice 180. A hard seat 178 is inserted into the counterbore 176 and retained therein. In this exemplary embodiment the seat 178 is press fit into the counterbore 176 however other retaining techniques could be used. It is preferred to minimize the gap between the end of the seat 178 and the outlet end of the fluid tip at the orifice 180.

It is noted at this time that in order to reduce costs of manufacture and reduce weight of the hand held guns, it is preferred to make the gun body 14, the extension 16 and the atomizing component 12 components from a high strength plastic material such as nylon or acetal or any other solvent resistant material to name a few examples.

The fluid tip 26 may be made, for example, of nylon for air spray applications, and PEEK (polyetheretherketone) for airless applications. The air cap 24 can be made, for example, from any polyamide, polyamidimide or PEEK.

When the atomizing component 12, and especially the fluid tip 170, is made out of plastic however, high fluid pressure used in airless and AAA guns may tend to wear the material in the area of the orifice 180. In accordance with another aspect of the invention, the seat 178 is preferably made of a material that is substantially harder than the material of the fluid tip 170. In the exemplary embodiment, the seat 178 is made of carbide. Other materials such as hardened stainless steel and sapphire for example could be used. For non-abrasive fluid applications, hard plastics such as PEEK could be used for the seat 178.

High pressure fluid is released from the orifice 180 but substantially only contacts the hard seat 178, thereby avoiding excessive wear of the fluid tip 170. There is no specific need for the carbide seat 178 in an air spray or HVLP configured gun because the fluid pressures are too low to cause excessive wear of the atomizing component 12.

The fluid tip of FIG. 8 can also be used for spray guns configured as AAA guns. An air assisted airless gun is very similar to an airless gun, but also uses atomizing air to further atomize the fluid. Accordingly, the fluid tip 170 of FIG. 8 includes a series of atomizing air jets 179 disposed about the orifice 180, in manner that can be but need not be the same as the atomizing air holes 50 in FIG. 4. For AAA guns then, an air cap 24 will also be used to direct the atomizing air to the annulus around the orifice 180.

Figure 9:
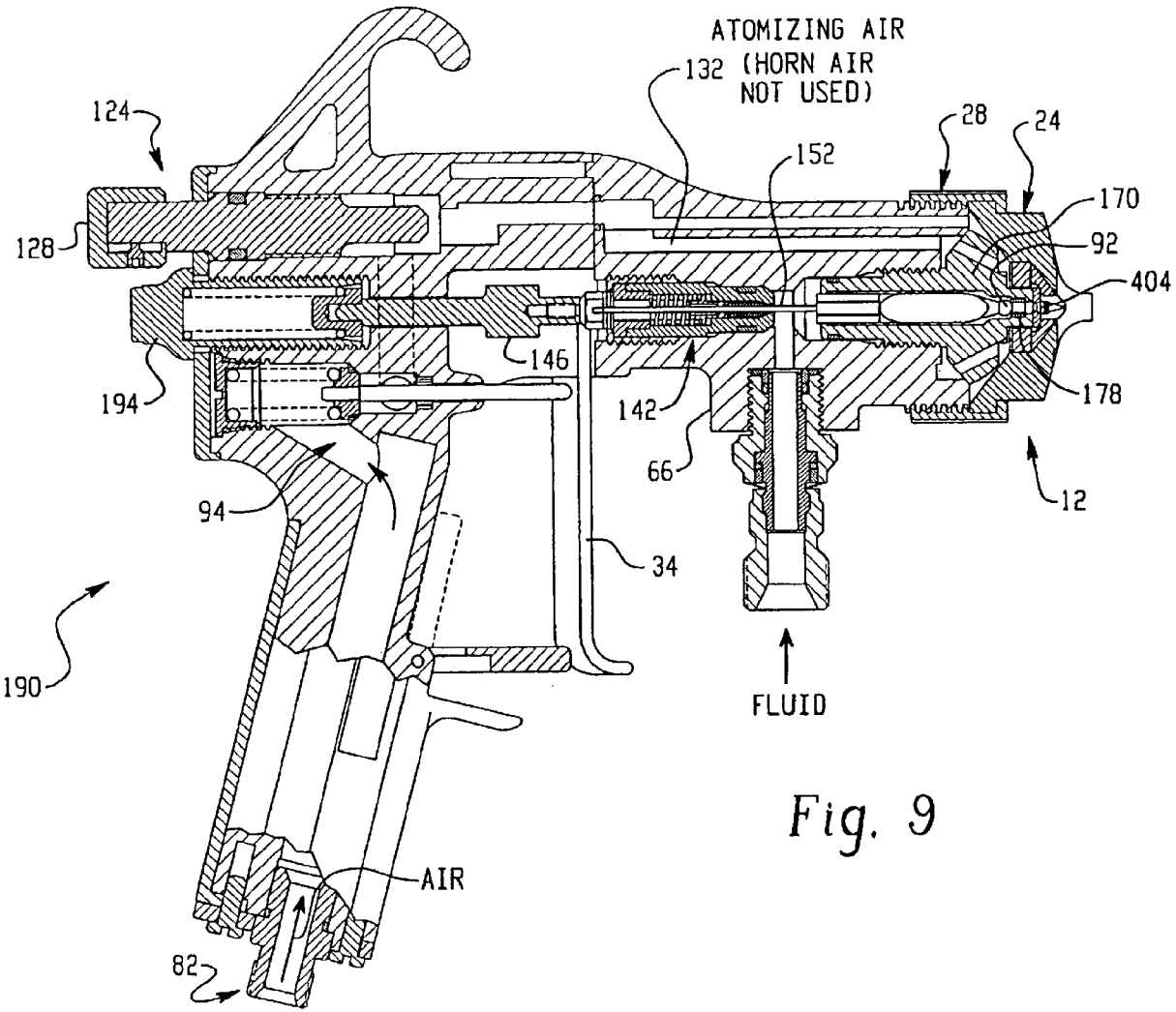
FIG. 9 is a modular spray gun configured to operate as an air assisted airless (AAA) gun.

Because the airless and AAA fluid tip 170 has a smaller orifice 180 as compared to the orifice 46 for air spray and HVLP nozzles, a needle valve is not as well suited for closing the orifice 180. FIG. 9 illustrates an embodiment of a AAA configured spray gun 190. The similarities in basic modular parts to the air spray and HVLP guns are readily apparent and like reference numerals are used to designate like parts. However, in order to control flow of the high pressure fluid to the atomizing component 12, a ball valve 192 is used to close the orifice 180 by seating against the carbide seat 178. The ball valve 192 is connected to the wire 152 of the puller 146. The packing cartridge 142, puller 146 and trigger control can be substantially the same as already described with respect to the air spray gun 10.

Figure 9A:
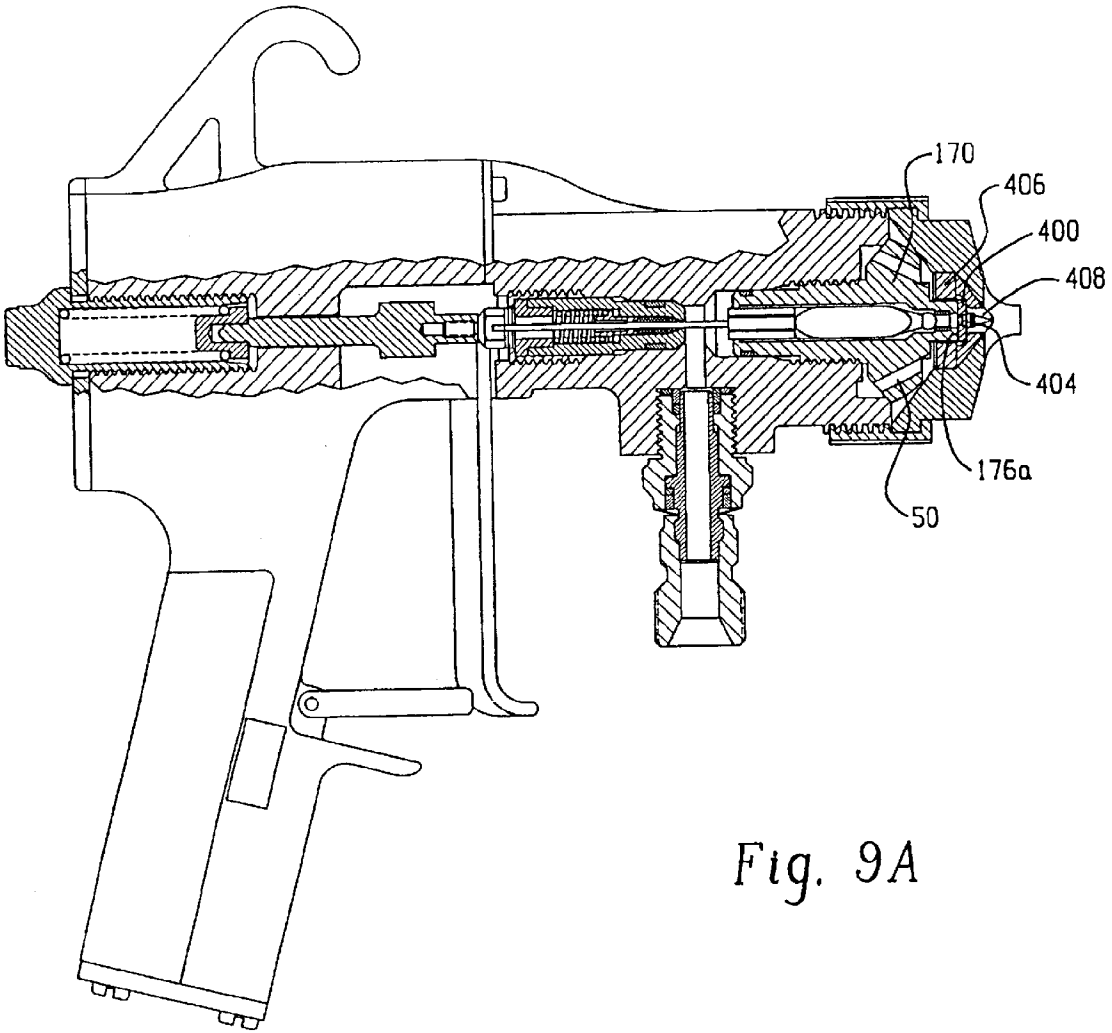
FIG. 9A is a modular spray gun configured to operate as an airless gun.

FIG. 9A illustrates an embodiment of a modular spray gun configured to operate as an airless spray gun as previously described herein. The airless gun is very similar to the AAA gun of FIG. 9 except that there is no provision for an air supply. Note that FIG. 9 shows clearer detail of the atomizing component 12 for the airless and AAA versions. A seal 400 such as made of PEEK or nylon is placed adjacent the fluid tip 170 forward face 176*a*. This seal 400 prevents the high pressure fluid from back flowing into the extension 16. The seal 400 can be provided with an optional pre-orifice, pre-atomizing device 404 such as a sapphire or carbide insert. The seal and the pre-orifice can alternatively be made from a single piece of carbide or other material. The atomizing component for the airless and AAA gun, further includes a holder 406 that is captured between the air cap 24 and the fluid tip 26. For a AAA gun, the holder 406 includes suitable recesses or passageways (not shown) that permit atomizing air from the air jets 50 to pass through to an annulus that surrounds the carbide nozzle 408. In an airless or AAA gun, the fluid tip 26 does not atomize the fluid, but rather the fluid is forced under high pressure first through the carbide seat 178, the optional pre-orifice 404 and then a carbide nozzle 408. The carbide nozzle 408 is formed with a suitable orifice through which the high pressure fluid is forced and thus achieves the final atomization for the airless gun, with atomizing air also being used for a AAA gun. The pre-orifice 404 is used to create turbulence in the fluid stream before it enters the nozzle 408, thus improving atomization for some types of fluids.

Figure 10:
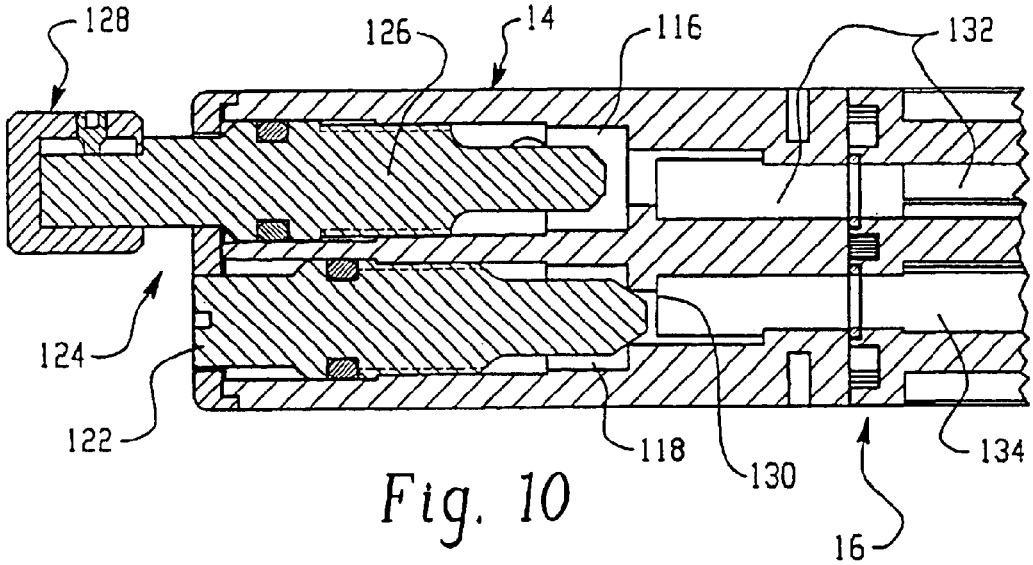
FIG. 10 is a partial top view in section of the spray gun of FIG. 9.

The AAA configured gun 190 is equipped for atomizing air the same way that the air spray gun 10 is equipped and thus includes the air fitting 82 and the air valve 94. However, the AAA gun 190 uses only atomizing air, not horn air. Accordingly, as illustrated in FIG. 10, the first air adjustment chamber 116 is equipped with the adjustment valve 124 to adjust atomizing air flow into the atomizing air flow passage 132 as previously described herein. The second air adjustment chamber 118 is plugged with the air plug 122. Note that the air plug 122 extends to block the port 130 thus blocking all air to the horn air passage 134.

Figure 11:
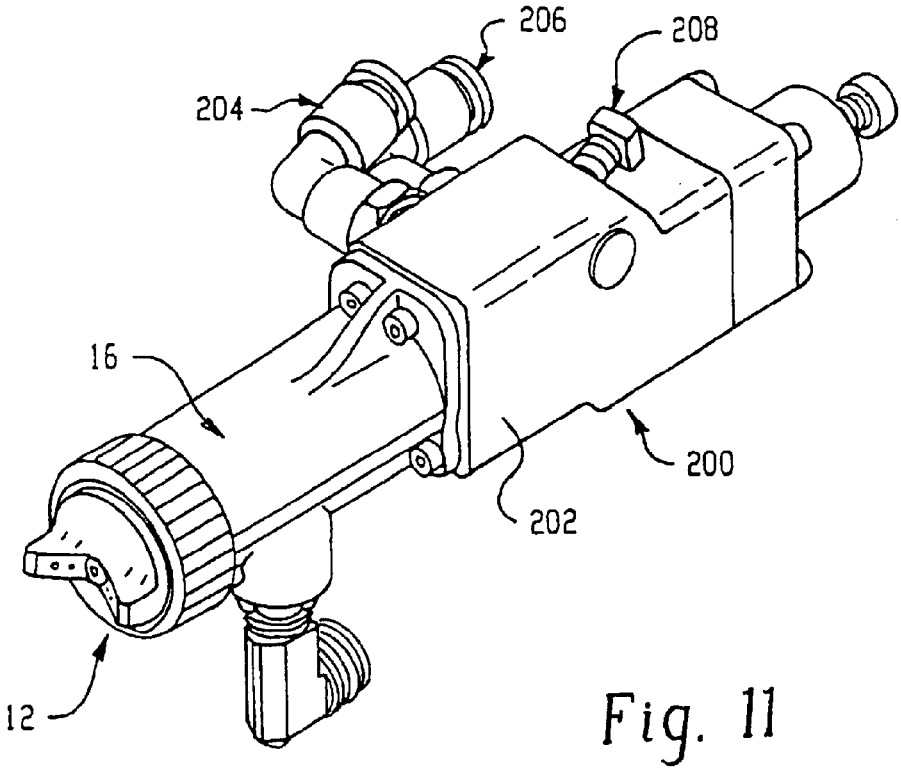
FIG. 11 is a perspective view of an automatic air spray gun.

The present invention also contemplates a modular spray gun concept for automatic guns. By automatic is simply meant that the guns are controlled and actuated other than by a manually actuated trigger mechanism. FIG. 11 illustrates an assembled non-circulating automatic air spray gun 200. The automatic air spray gun shares many modular parts with the manual gun of FIG. 1 including the atomizing component 12 and the extension 16. However, the gun body 14 has been replaced by a modular control block body 202. In this embodiment, the control block is realized in the form of a control piston block. The control block 202 includes separate air inlet fittings for horn air 204 and atomizing air 206. A bolt 208 can be used to mount the gun body 202 on a robot arm or other apparatus that is used to position the gun at a desired location or to control its movement.

Figure 12:
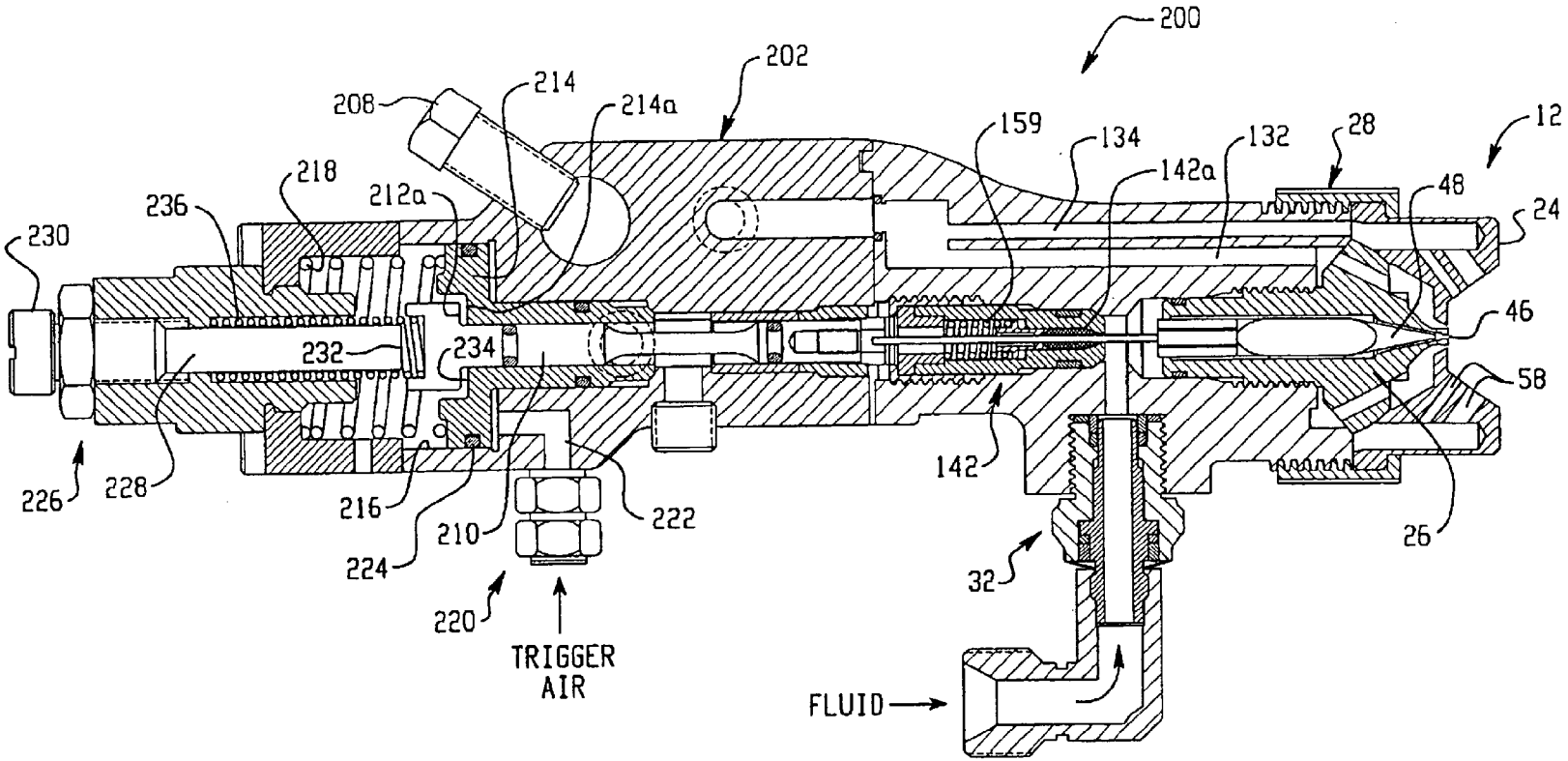
FIG. 12 is a vertical cross-sectional view of the automatic air spray gun of FIG. 11.

FIG. 12 illustrates the automatic air spray gun in vertical cross-section. It is readily apparent that the extension 16 and the atomizing component 12 can be substantially the same as those modular parts used for the manual gun. The control block 202 is different from the modular gun body 14, however. Since there are separate controlled and automatically regulated inputs for the horn air and atomizing air, there is no need for an air valve nor for the air adjustment chambers. The horn air fitting 204 is in fluid communication with the horn air passage 134 and the atomizing air fitting is in fluid communication with the atomizing air passage 132.

Since there is no manual trigger, a different puller mechanism is used. The needle valve 48 is still actuated by pulling on a wire connected to the needle, as in the manual gun 10, however, the wire 152 is securely connected to a connecting rod 210. This rod 210 extends rearward through the control body 202 to an enlarged cup end 212. The connecting rod 210 is fixed to a control piston 214 that is mounted for sliding axial movement within a bore 216. The piston 214 is biased by a spring 218 to a closed position as illustrated in FIG. 12.

A trigger air inlet fitting 220 provides pressurized trigger air to a trigger air conduit 222. The conduit 222 opens to the valve bore 216 on the side of the piston 214 opposite the bias spring 218. An o-ring seal 224 maintains fluid tight isolation between the portions of the bore 216 on either side of the piston 214. When trigger air is supplied to the inlet 220, the piston 224 is moved backwards against the force of the spring 218, moving the connecting rod 210 and the needle 48 with it, and thus the needle valve for the atomizing component 12 opens the orifice 46. When the trigger air is removed the atomizing component 12 closes due to the spring 218 returning the piston 214 to the closed position of FIG. 12.

A fluid flow adjustment device 226 is provided if required. This device 226 is a threaded needle 228 that can be turned by turning an adjustment knob 230. When the needle 230 is turned its distal tip 232 can be positioned so as to limit the distance that the connecting rod 212 can be retracted, with the needle tip 232 acting as a stop.

In order to have the atomizing air flowing before the atomizing component 12 is open for fluid flow, a small gap 234 is provided between a rearward surface 214*a* of the piston 214 and the forward flange surface 212*a* of the cup 212. This gap 234 provides a lost motion between initial movement of the piston 214 in response to the trigger air and movement of the connecting rod 210 in order to delay to opening the atomizing component 12 until the atomizing air is flowing. Thus if trigger air and atomizing air are applied to the gun at the same time there will be a momentary delay until fluid begins to flow from the atomizing component 12. A second spring 236 is used to bias the connecting rod 210 to a closed position (as in FIG. 12).

As with the manual embodiments, the automatic air spray gun 200 is the same configuration as used for an HVLP automatic gun with the only required change being to select the appropriate atomizing component 12 to effect HVLP operation.

Although not shown in the drawings, the automatic air spray gun 200 can easily be re-configured to operate as an automatic airless gun or a AAA gun. For an airless automatic gun, the air fittings 204, 206 can be removed and the corresponding ports plugged. The atomizing component 12 is also selected for an airless operation as previously described, and the needle valve 48 changed to a ball valve, for example. For an automatic AAA gun, the atomizing air fitting 206 is used but the horn air fitting 204 can be removed. These simple configuration changes are all that is needed to use the modular control block 202 and the extension 16 and atomizing component 12 with any of the spraying processes described herein.

Figure 13:
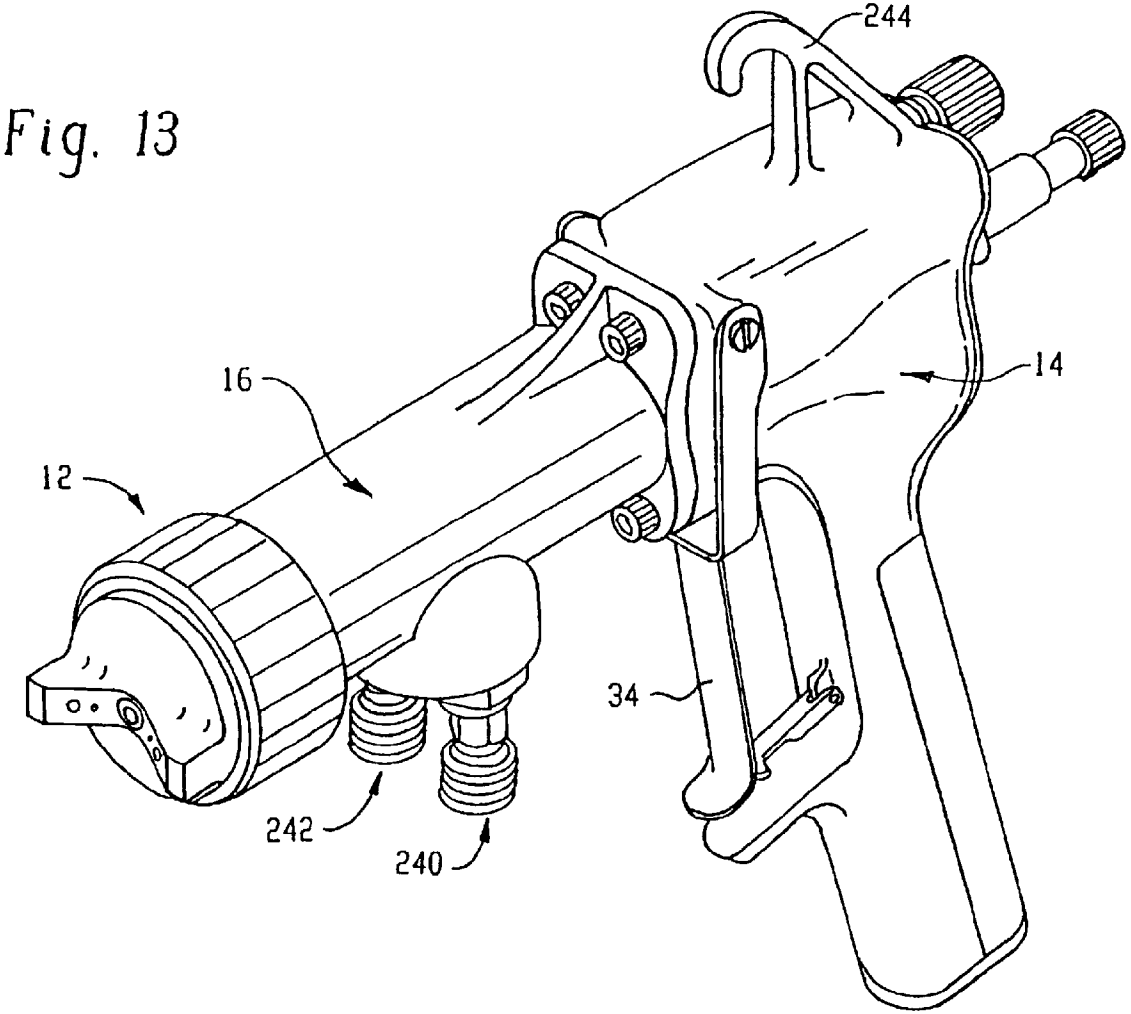
FIG. 13 is a perspective of a circulating manual air spray gun.

FIG. 13 illustrates another aspect of the present invention. In some applications, such as heated fluids, it is desirable to re-circulate the fluid particularly when the gun is idle. This can help to prevent the fluid heaters from caking up or clogging. In order to accommodate this function, the modular extension 16 can be modified as a circulating version 16' to include an additional fluid port. Thus there is an inlet fluid port 240 and an outlet fluid port 242 although the reference to inlet and outlet are arbitrary. Either port could serve as the inlet port. These ports are both in fluid communication with the fluid chamber 136 inside the extension 16. Whenever the atomizing component 12 is closed, the fluid simply re-circulates back to the fluid source. In all other respects the circulating extension 16' may be the same as the non-circulating extension 16. Of course, the circulating extension 16' can be used with any of the spray gun configurations described herein.

Also, the modular gun body 14 can be provided with a hook extension 244 for hanging the gun 10 when not in use.

Figure 14A:
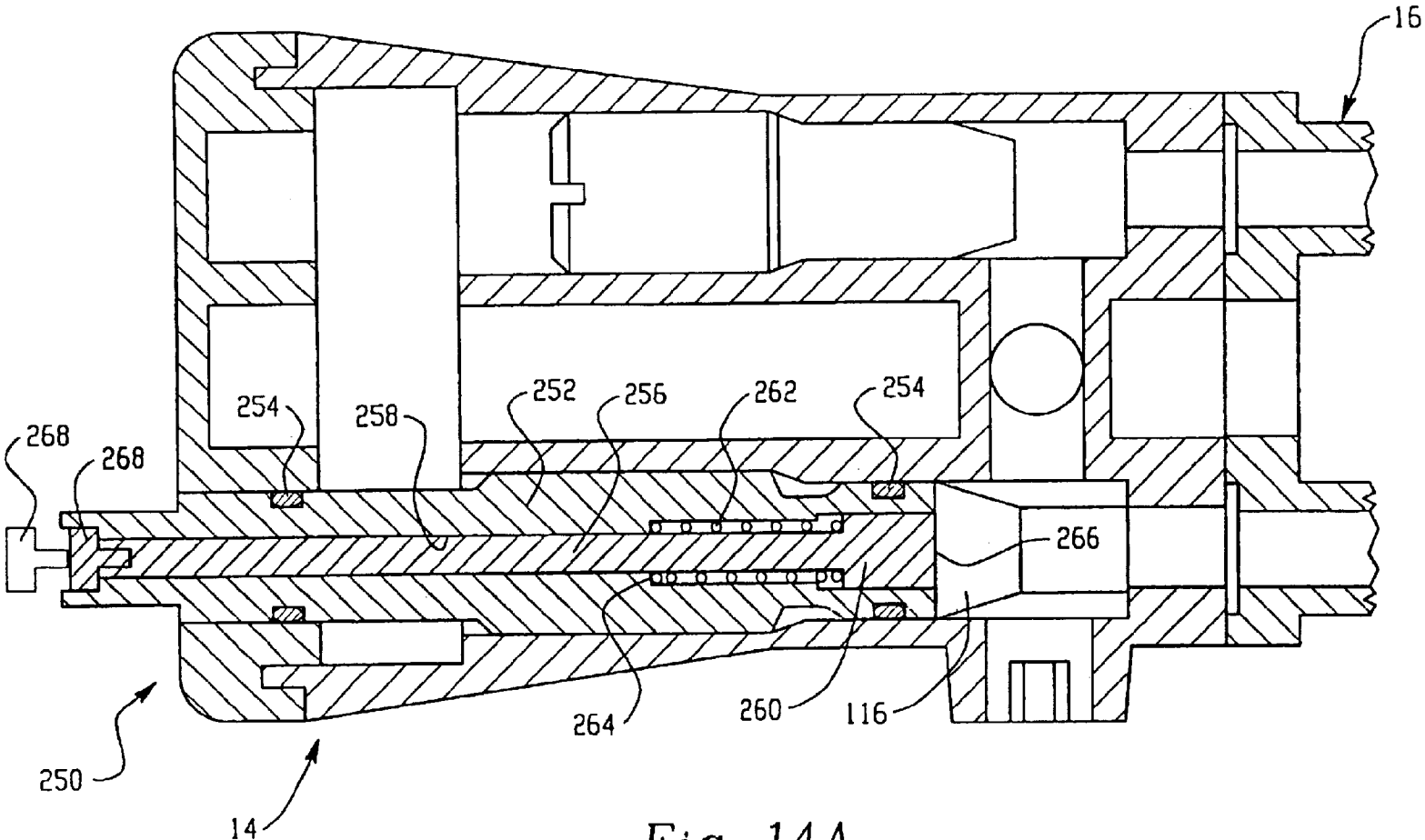
FIGS. 14A and 14B illustrate another aspect of the invention to provide HVLP pressure compliance with an indicator device or a relief valve.
Figure 14B:
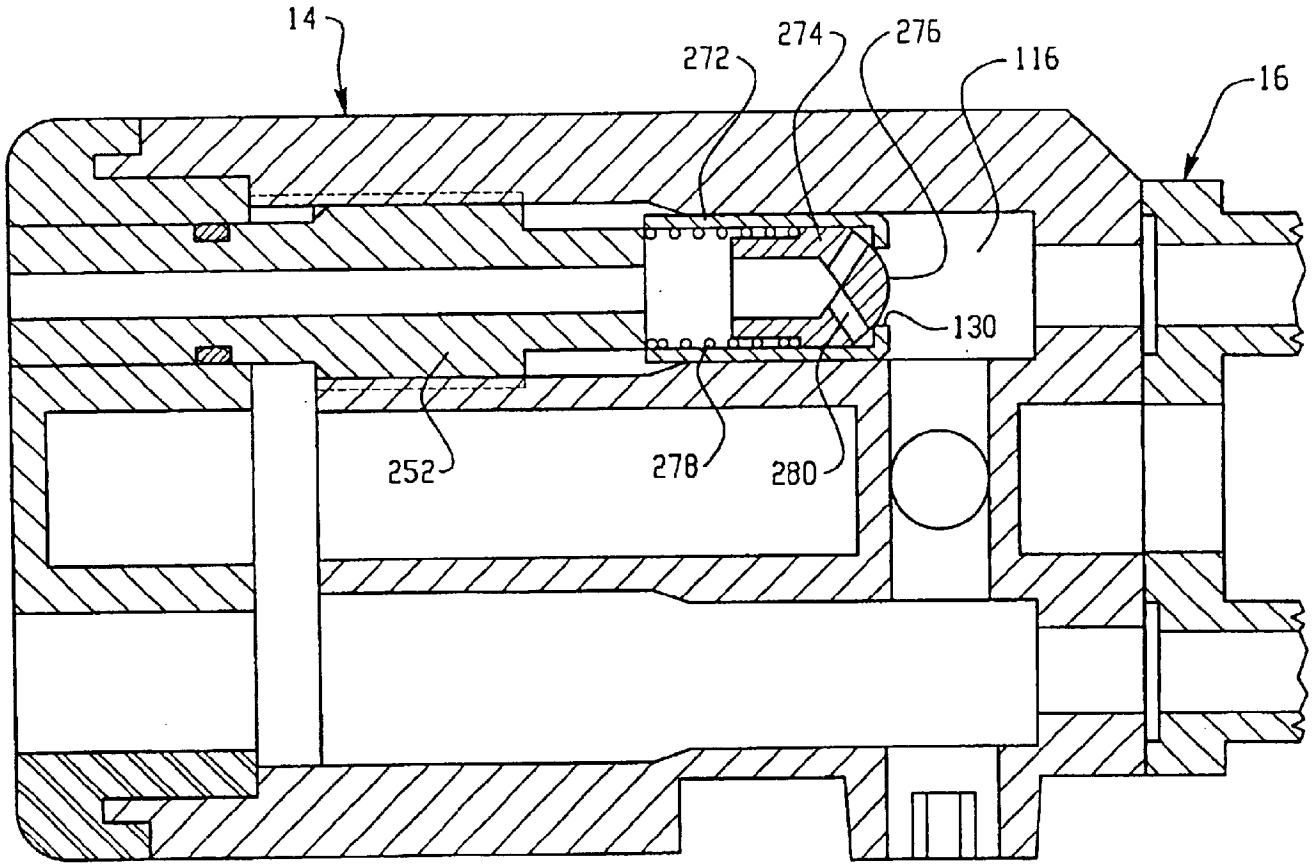

For HVLP guns it may be desirable in some cases to provide an indication if the gun is out of compliance with the less than 10 psi rating requirement. In accordance with another aspect of the invention, the modular gun designs herein, particularly the manual HVLP guns, can be easily modified to include such a feature. FIGS. 14A and 14B show two embodiments. In FIG. 14A, a direct visual compliance indicator mechanism 250 is provided. This mechanism 250 can be installed, for example, as an option into the otherwise plugged first air adjustment chamber 116 of FIG. 7 (in this example the mechanism 250 is being used with a air spray configured gun).

The compliance indicator mechanism 250 includes a plug body 252 that is threaded into the chamber 116. O-ring seals 254 can be used to seal the body 252 within the chamber 116. An indicator stem 256 is disposed for axial sliding movement within a central bore 258 in the plug 252. The stem 256 includes an enlarged head 260 and a bias spring 262 is positioned between the head 260 and a counterbore 264. The spring 262 biases the stem 256 inward into the gun body 14. A forward face 266 of the stem 256 is exposed to the pressurized air within the air passage 116. If this pressure reaches 10 psi or greater, the stem 256 is displaced against the force of the spring 262 and an indicator tip 268 that is attached to the stem 256 pops out of the gun body 14 (shown in phantom in FIG. 14A). If the pressure drops back to within compliance the spring 262 returns the stem 256 to the retracted position within the gun body 14 (as in FIG. 14A).

FIG. 14B is a variation in the form of a relief valve 270. In this embodiment, the plug body 252 is axially shorter and telescopes into a retainer sleeve 272. A pressure relief ball 274 is sized to slide within the sleeve 272. The ball 274 has a forward portion 276 that seals the port 130. The ball 274 is biased to the closed position of FIG. 14B by a spring 278. When the pressure in the passage 116 reaches 10 psi or higher the relief ball 274 is pushed rearward. Pressure is then relieved through vent holes 280. When the pressure returns to less than 10 psi the ball re-seats and seals the port 130 under force of the spring 278.

Figure 15:
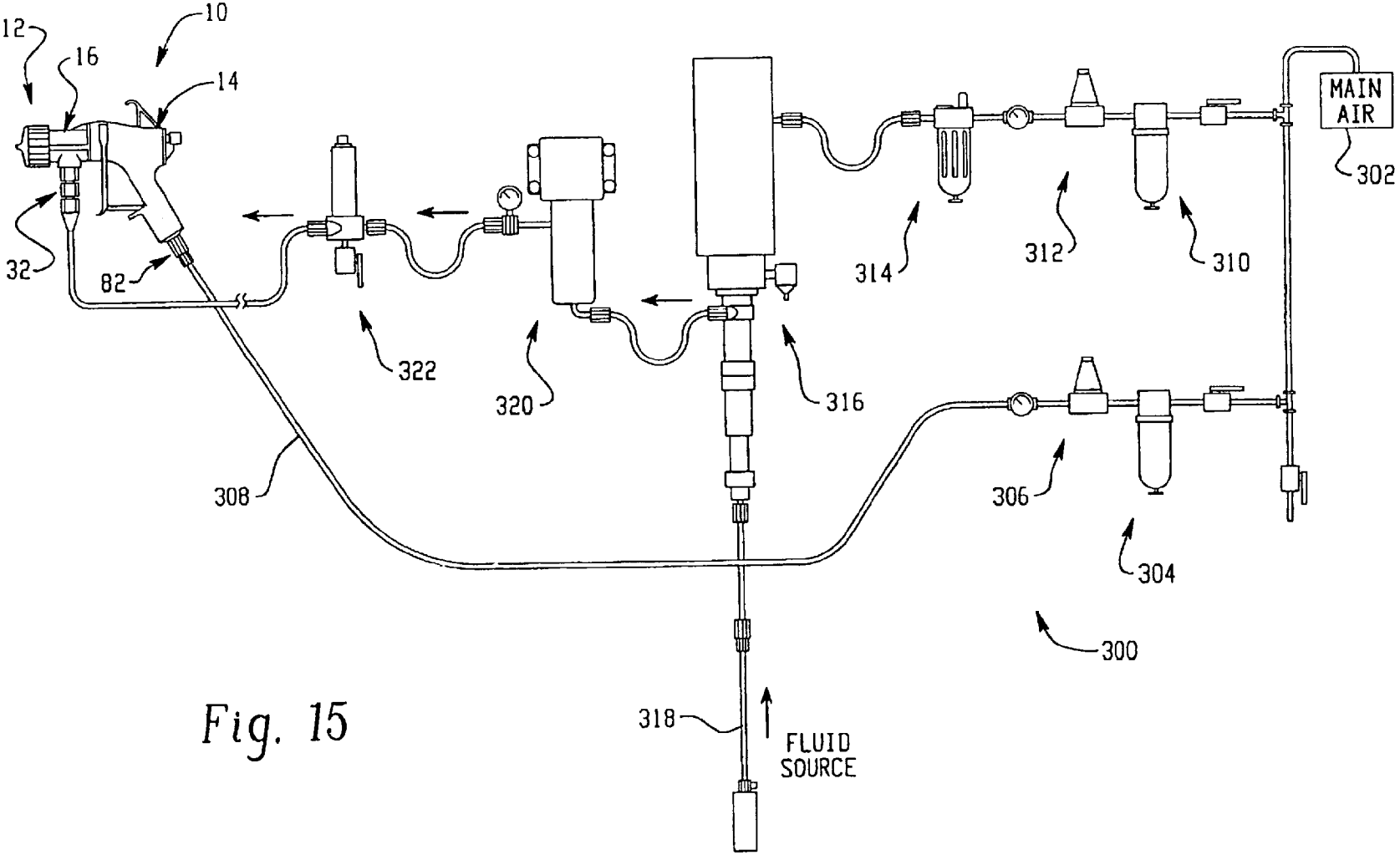
FIG. 15 is a system schematic for a non-circulating spray system that uses a modular spray gun according to the invention.
Figure 16:
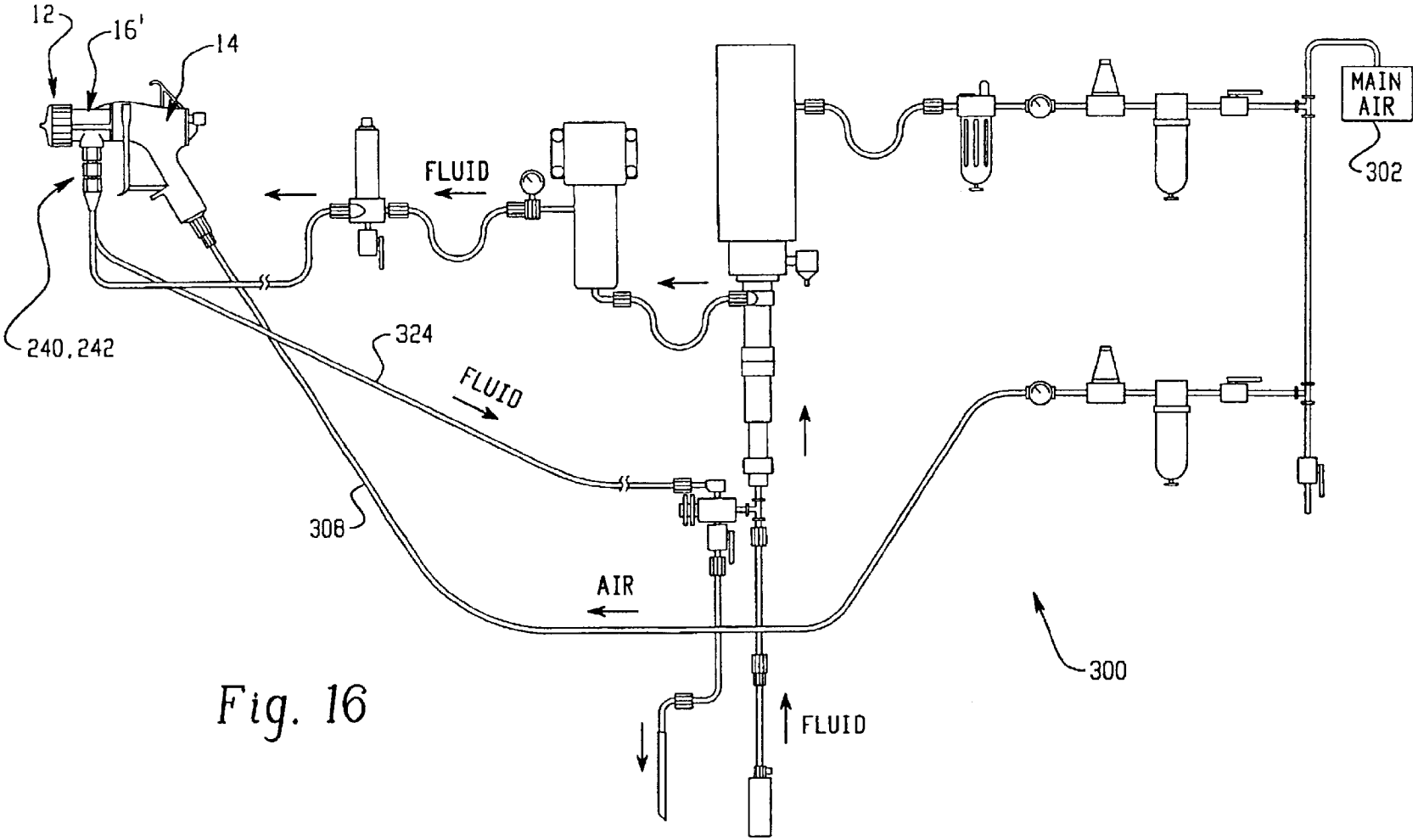
FIG. 16 is a system schematic for a circulating spray system using a modular gun of the present invention.

FIG. 15 is a schematic illustration of a typical spray system 300 using a modular non-circulating air spray gun 10 in accordance with the invention. The system 300 includes a main air supply 302 that feeds into a first air filter 304 and through a regulator 306 to an air line 308 that is connected to the atomizing air inlet fitting 84 (FIG. 4). Main air 302 is also fed to a second air filter 310, regulator 312 and a lubricator 314. This air is used for an air driven pump 316 such as pump no. 166476 available from Nordson Corporation. The pump 316 draws up fluid to be sprayed through a siphon line 318. The fluid can be heated as required with a heater 320 and again filtered at 322 before being fed into the extension 16 at the fluid inlet fitting 32 (FIG. 4). FIG. 16 is similar to FIG. 15 but for a circulating spray gun. In this embodiment, the extension 16' includes the inlet and outlet ports 240, 242 (FIG. 13) with the outlet port being connected to a fluid return line 324. In this arrangement the fluid is re-circulated while the gun 10 is idle.

Figure 17:
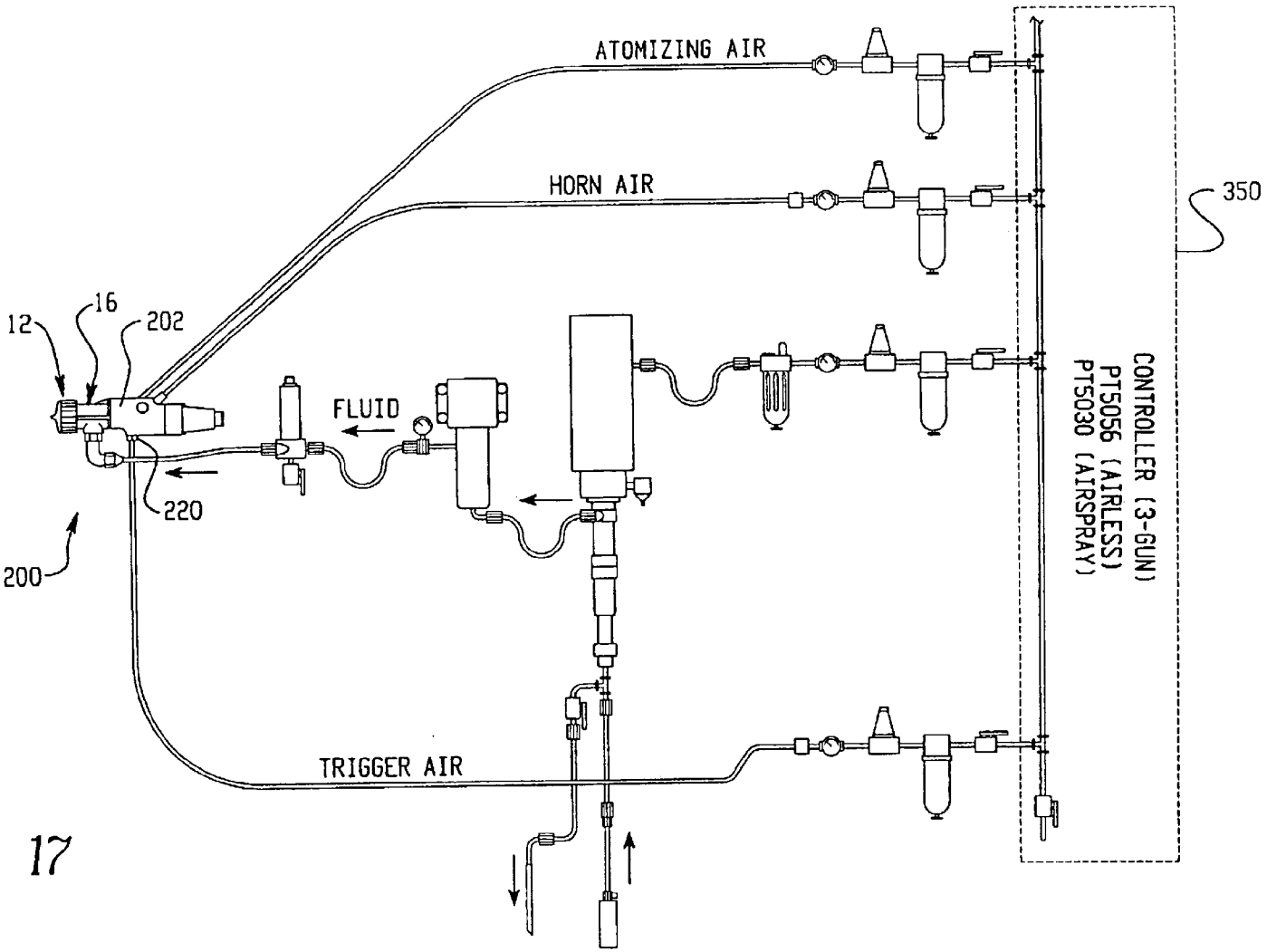
FIG. 17 is a system schematic for an automatic non-circulating spray system.

FIG. 17 illustrates an automatic spray system for a modular automatic air sprayer in accordance with the invention. The atomizing air and fluid are provided to the gun 190 in a manner similar to FIG. 15. In addition, filtered and regulated horn air is provided to the horn air fitting 204 (FIG. 11) through air line 326. The trigger air is supplied through an air line 328 to the trigger air fitting 220 (FIG. 12). Atomizing air, horn air and trigger air, and fluid flow, can be controlled via a suitable controller 350 such as PT 5056 (airless) or a PT 5030 (air spray) available from Nordson Corporation.

Note that in FIG. 2 a rigid fluid tube connection 290 is shown connected to the fluid fitting 32 as is sometimes used in airless and AAA spraying applications.

Figure 18:
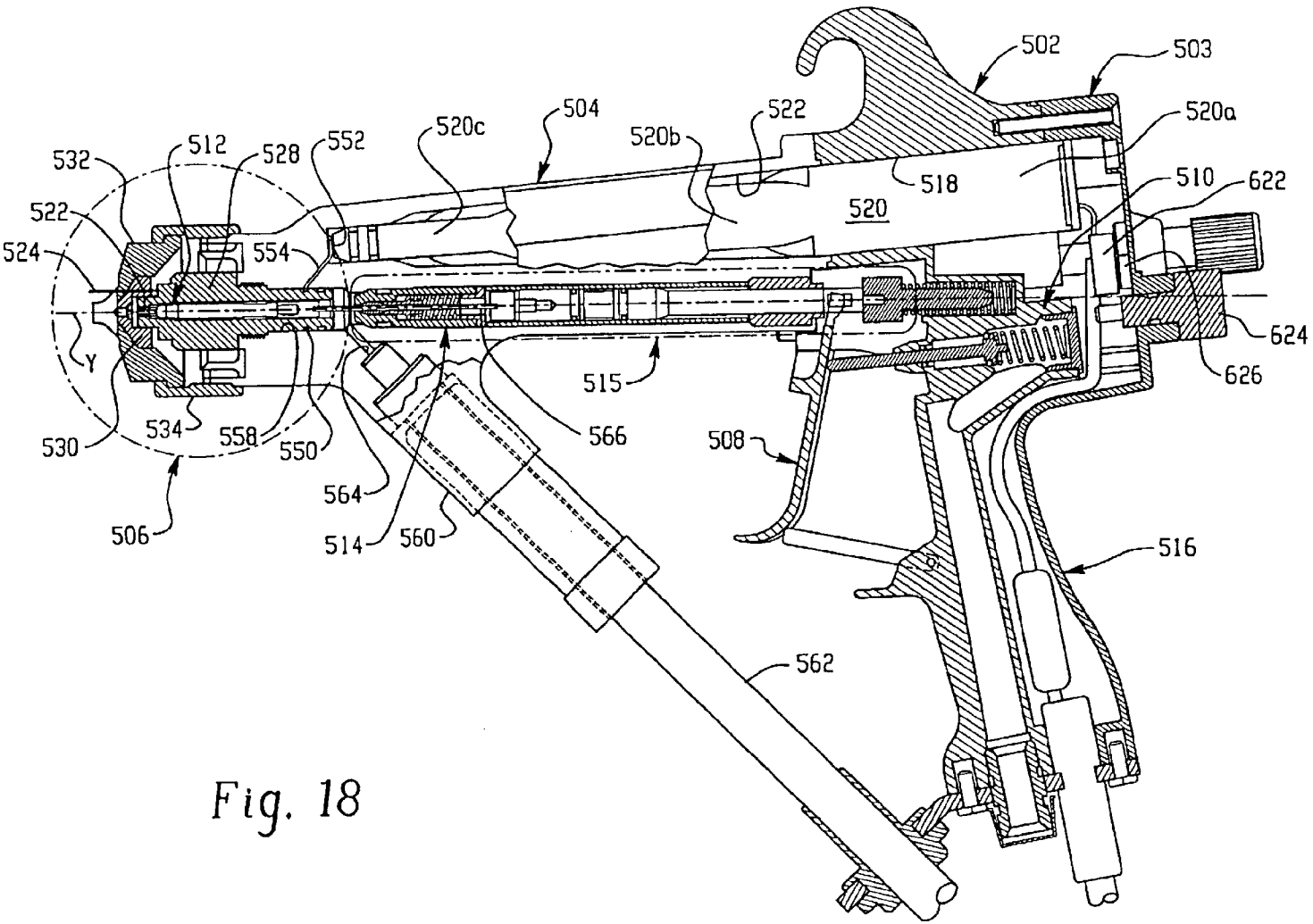
FIG. 18 illustrates an electrostatic version of a modular fluid spray gun in vertical longitudinal cross-section.

With reference to FIG. 18, an embodiment of a high pressure manual electrostatic version of the modular gun concept is illustrated. Many of the modular features of the electrostatic gun 500 are the same as the non-electrostatic gun embodiments described hereinbefore and therefore need not be repeated. These include the three section modular assembly of a gun body 502, extension body 504 and atomizing component 506; the air management features for atomizing and horn air used for the various selectable spraying technologies; the trigger 508 operated air valve 510 and fluid control valve 512, a valve pull shaft assembly 515 that includes the packing cartridge assembly 514; as well as both automatic and manual versions. All of these basic features may be implemented in the electrostatic version of the modular gun 500 in a similar manner, as described herein with respect to the non-electrostatic version.

The gun body 502 is provided with a removable back end 503 which allows the multiplier 520 and other replaceable parts to be easily accessed or assembled. The gun body further includes a grip handle 516 in the manual version of the gun 500 as illustrated in FIG. 18. The gun body 502 includes a central cavity 518 that receives a rearward end of a power supply, such as for example, a high voltage multiplier 520. The multiplier 520 may be conventional in design as to the electrical operation thereof as is well known to those skilled in the art. The cavity 518 is continuous with a central cavity 522 that extends through the extension 504. When the multiplier 520 is to be used in the gun 500, the extension 504 will typically be longer than the extension 16 in the non-electrostatic versions described hereinabove. Additionally, because of the longer extension 504, the packing cartridge 514 will be separated axially further from the puller 568 (compare, for example, FIG. 18 with FIG. 5). Thus, with the electrostatic version that includes a power supply 520 in the extension 504, a valve puller shaft assembly 515 is used to pull the wire 566 in response to actuation of the trigger 508.

In accordance with one aspect of the invention, the multiplier 520 is longitudinally tapered in a stepwise fashion from back to front. In this exemplary embodiment, the multiplier 520 includes a three section profile, with the largest and heaviest rearward section 520*a* being disposed in the gun body 502, an intermediate section 520*b* and a forward section 520*c*, both latter sections being disposed within the extension 504. This taper design and back-end weight distribution allows the overall size of the extension 504 to be reduced, and also places most of the multiplier 520 weight directly over the handle 516. This prevents imbalance of the gun 500, thus reducing operator fatigue. As an example, the rearward section 520*a* may include a transformer, oscillator, circuit board, indicator lights and so on. Since it is the largest section of the multiplier 520, it will also have the largest quantity of potting material and thus the highest weight distribution. The intermediate section 520*b* may be used, for example, to enclose a capacitor/diode stack, while the forward section 520*c* may be used to enclose some load resistors. Other multiplier designs may dictate different component locations, of course, but the significant feature is to redistribute as much of the weight over the handle 516 as possible. This reduces what would otherwise be a bending moment due to too much weight forward of the handle 516, which tends to cause operator fatigue. In one example, a multiplier 520 has been realized in accordance with the present invention wherein about half of the total multiplier 520 weight is in the rearward section 520*a*, with 38% of the weight in the intermediate section 520*b*, and only about 13% in the forward most section 520*c* that overhangs the handle 516 the farthest.

For the high pressure version of an electrostatic modular gun 500 illustrated in FIG. 18, the valve assembly 512 may be substantially the same as described hereinbefore. However, in the high pressure version, the outlet orifice 522 is too small to accommodate an electrode 524 without disturbing the spray pattern or otherwise forming the electrode too small. Accordingly, the discharge electrode 524 is disposed off axis relative to the central longitudinal axis of the control valve assembly 512.

Figure 19:
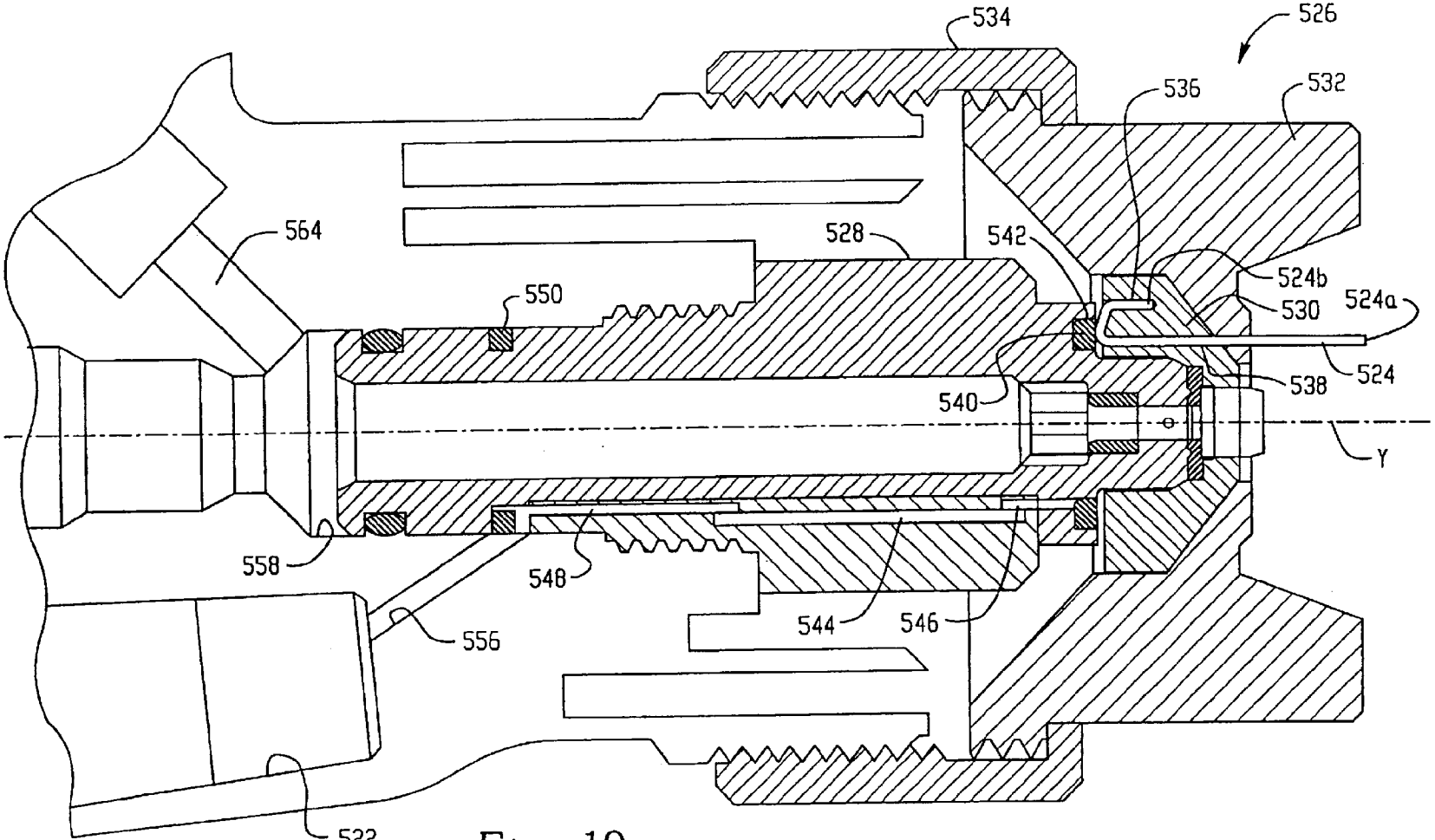
FIG. 19 is a more detailed view of an electrode circuit in a high pressure version of an electrostatic modular spray gun.

With reference to FIG. 19, an embodiment of a high pressure nozzle assembly 526 that is part of the atomizing component 506 is illustrated. The flow control valve 512 is omitted for clarity. The basic nozzle assembly 526 includes a fluid tip 528, a nozzle holder 530, an air cap 532 and a retaining ring 534. These components cooperate in a manner substantially the same as described hereinbefore for the non-electrostatic version, but in particular the fluid tip 528 and related components have been modified to accommodate the electrode 524, as described herein after.

The holder 530 includes a blind bore 536 and a throughbore 538. The electrode is generally J-shaped in this example such that the discharge end 524*a* is inserted through the bore 538 and the short second end 524*b* is inserted into the blind bore 536. The electrode 524 thus extends through the holder 530 off center from the central longitudinal axis Y of the fluid tip 528 and does not pass through the outlet orifice of the nozzle. The lower curved portion of the J-shaped electrode 524 is exposed outside the holder 530. When the holder 530 and the fluid tip 528 are fully assembled, electrode 524 makes electrical contact with an electrically conductive carbon filled teflon ring 540 that is press fit or otherwise retained in a groove 542 in the fluid tip 528. The ring 540 may also be molded in place when the fluid tip 528 is molded. The ring 540 may be made of any suitable conductive material.

A resistor 544 is disposed within a groove in the fluid tip 528. Preferably though not necessarily, the resistor 544 is molded in place with the fluid tip 528. A first conductor lead 546 is also preferably molded in place in the fluid tip 528 and electrically connects a forward end of the resistor 544 with the conductive ring 540. A second conductor lead 548 is also preferably molded in place in the fluid tip 528 and electrically connects a rearward end of the resistor 544 to a second conductive ring 550. The second ring 550 may also be realized in the form of a carbon filled teflon ring, although either or both rings 540, 550 can be made of any suitable conductive material. Preferably but again not necessarily the second ring 550 is also molded in place in the fluid tip 528 and is exposed during the machining process for finishing the fluid tip 528.

The fluid tip 528 thus includes an integral and preferably molded in place electrical circuit comprising the resistor 544 and the leads 548, 546. Of course, the electrical resistor 544 may be integrally formed with the leads 548, 546.

With reference again to FIG. 18, the forward end of the multiplier 520 includes an output contact terminal 552. A conductor wire 554 extends through a bore 556 (FIG. 19) to a bore 558 in the extension 504 to connect the multiplier 520 output to the second conductive ring 550. When installed, the wire 554 makes electrical contact at a first end with the multiplier output terminal 552 and at a second end with the second conductive ring 550 (FIG. 19). In this manner, the multiplier high voltage output is electrically connected to the electrode 524 via the electrical circuit in the fluid tip 528.

The extension body 504 includes a fluid inlet arm 560. A fluid feed hose 562 is slideably received at the inlet and is coupled at an opposite end to a supply of fluid such as liquid paint for example. The inlet 560 includes a thoroughbore 564 that opens to the bore 558 just upstream of the fluid tip 528.

Figure 20:
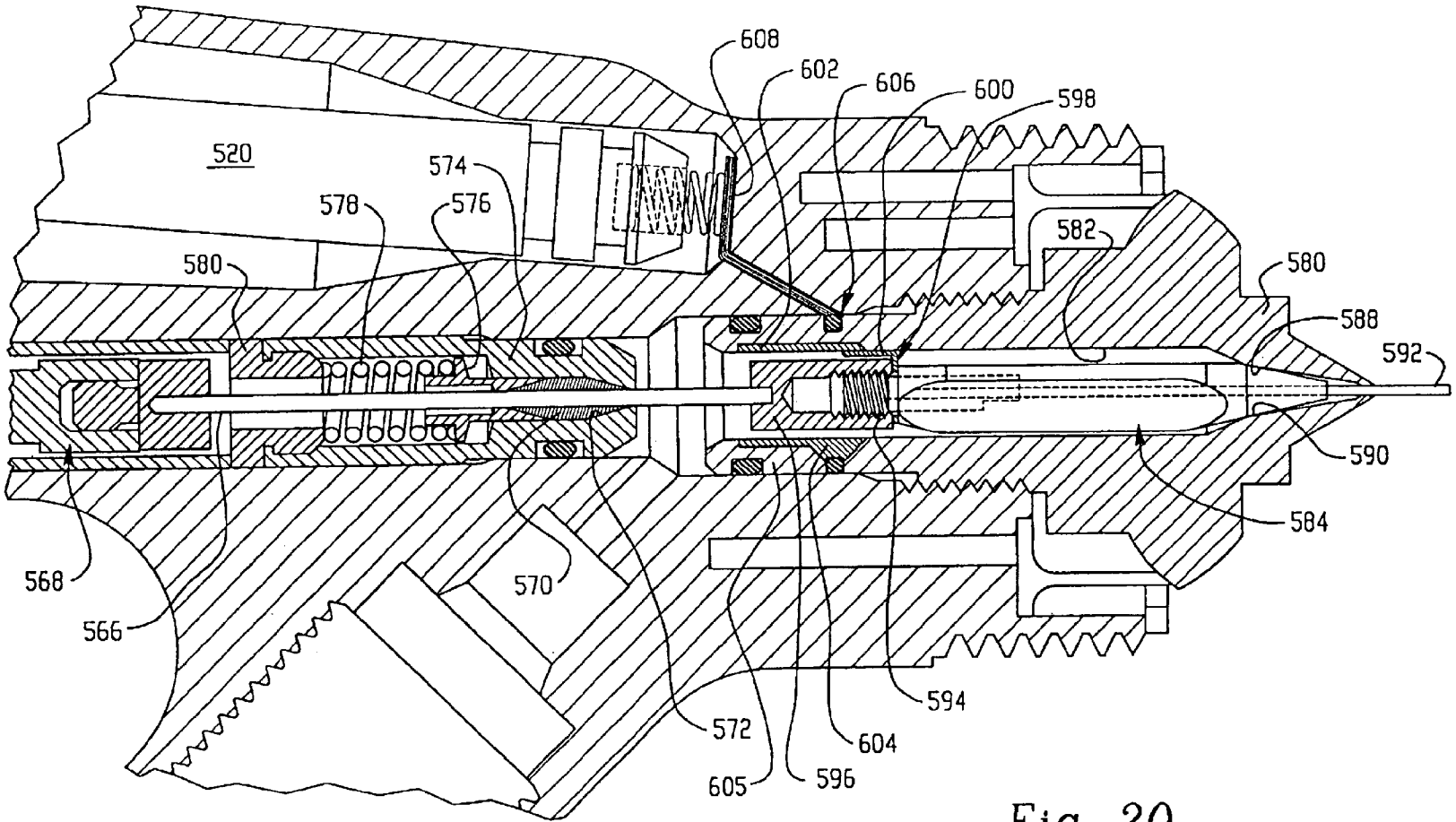
FIG. 20 is a detailed illustration of an electrode circuit for a low pressure version of an electrostatic modular spray gun.

The shaft puller assembly 515 in cooperation with the puller 568 and the trigger 508 and the wire 566 operates the flow control valve 512 as previously described hereinabove. FIG. 20 illustrates an enlarged view of the packing cartridge 514. FIG. 20 further illustrates a low pressure nozzle assembly for the atomizing component 506, however, the packing cartridge 514 is substantially the same for all the exemplary embodiments herein (note that in FIG. 20 the air cap and retaining ring are omitted for clarity). The puller assembly 515 includes the puller wire 566 that is attached at a forward end to the valve mechanism 512 and at a rearward end to a puller 568 that operates in response to actuation of the trigger 508 via the pull shaft assembly 515.

The packing cartridge 514 advantageously provides a fluid seal between the forward section of the gun 500 and the rearward section of the gun 500, and also provides a significant isolation of the electrostatic energy from ground. This is accomplished in the preferred embodiment by eliminating most of the metal parts of the packing 514, compared to, for example, the packing cartridge 142 used in the non-electrostatic guns described hereinabove. By substantially reducing conductive materials in the packing cartridge 514, the overall capacitance is greatly reduced, thus significantly reducing the risk of a discharge to ground. Thus, in the electrostatic gun 500, the packing cartridge 514 is preferably made of mostly plastic parts, for example, PEEK, with the only metal in this embodiment being the puller wire 566 and the spring 578. With the puller 568 being also made of non-conductive materials, there is a substantial reduction in the risk of electrostatic discharge to ground even though the puller wire 566 is exposed to the charged fluid. This is accomplished by reducing the capacitance of the cartridge assembly 514 by eliminating metal and also having a substantial distance between the cartridge assembly 514 and the rearward end of the gun. The packing 570 therefore provides both a fluid seal as well as an electrostatic seal.

The puller wire 566 reciprocally extends through a packing seal 570. A suitable material for the packing 570 is Teflon. This packing 570 acts as both a fluid seal against back pressure of the fluid being dispensed through the nozzle, and also acts as an electrostatic barrier between the fluid and ground.

The packing 570 is disposed in a tapered bore 572 of a packing sleeve 574. A tapered plunger or pusher 576 is biased forwardly by a spring 578 that is retained in the sleeve 574 by an end cap 580. Preferably the forward tapered end of the packing 570 is formed at a slightly different taper angle than the tapered bore 572. This assures a circumferential line contact seal between the packing 570 and the sleeve 574. The spring biased plunger 576 maintains a self-adjusting and dynamic load and sealing force applied to the packing 570 in order to maintain a good seal not only against the sleeve 574 but also around the wire 566. Without the dynamic self-adjusting feature, the packing 570 would tend to wear more quickly due to the moving wire 566 and fluid pressure, and thus eventually lose its seal, even if a high static load is initially applied to the packing 570.

Figure 21:
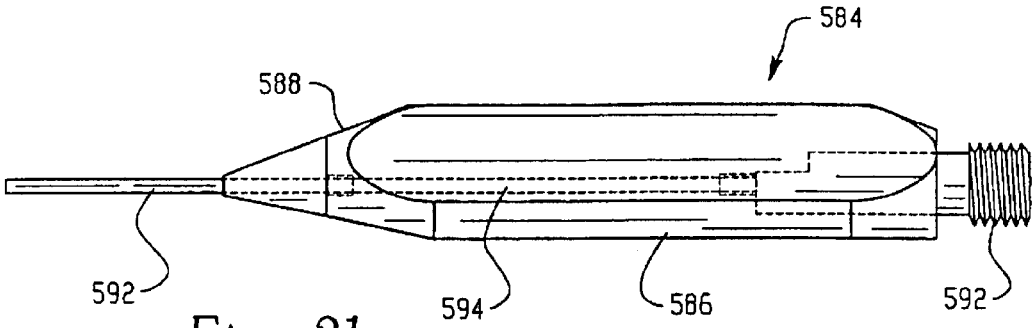
FIG. 21 illustrates a needle valve element such as may be used in the embodiment of FIG. 20.

With continued reference to FIG. 20, an electrode connection circuit is illustrated for the low pressure embodiment of an electrostatic modular spray gun 500. As in the above-described non-electrostatic gun embodiments, the atomizing component includes a fluid tip 580 having a central bore 582 therein that receives a needle valve 584. In accordance with one aspect of the invention, and as shown more clearly in FIG. 21, the needle valve 584 includes a plastic valve body 586 having a forward tapered end 588 that seals against a valve seat 590 in the fluid tip 580.

An electrode 592 is molded in place in the needle valve 584 with a portion extending axially forward of the needle 584. Within the needle body 586 the electrode 592 electrically contacts a resistor 594 that is molded in place in the needle body 586. The needle body 586 includes a threaded end 592 that is inserted into a threaded hole 594 in a wire holder block 596. Thus, axial rearward movement of the wire 566 pulls the needle valve 584 away from the valve seat 590 to open the outlet orifice of the nozzle. An electrical connector in the form of a contact washer 598 is installed on the needle 584 and held in place when the needle 584 is installed in the holder block 596. The connector 598 makes contact with the embedded resistor 594 molded in the needle 584. This may be accomplished, for example, by having a resistor lead (not shown) exposed after final machining of the needle body 586, which contacts the connector 598 after assembly of the parts.

The connector 598 includes a rearward extending flange 600 that makes electrical contact with a conductive carbon filled PEEK insert 602 in the rearward end of the fluid tip 580. Other conductive materials may be used as required for the insert 602. The conductive insert 602 includes a radially extending contact portion 604 that extends through the rear cylindrical wall 605 of the fluid tip 580. The contact portion 604 makes electrical contact with a carbon filled teflon conductive ring 606. The ring 606 makes contact with one end of a multiplier output wire 608. The opposite end of the multiplier wire 608 extends through a bore in the extension body 504 and contacts an output terminal of the multiplier 520, in a manner similar to the embodiment of FIG. 18.

Figure 22A:
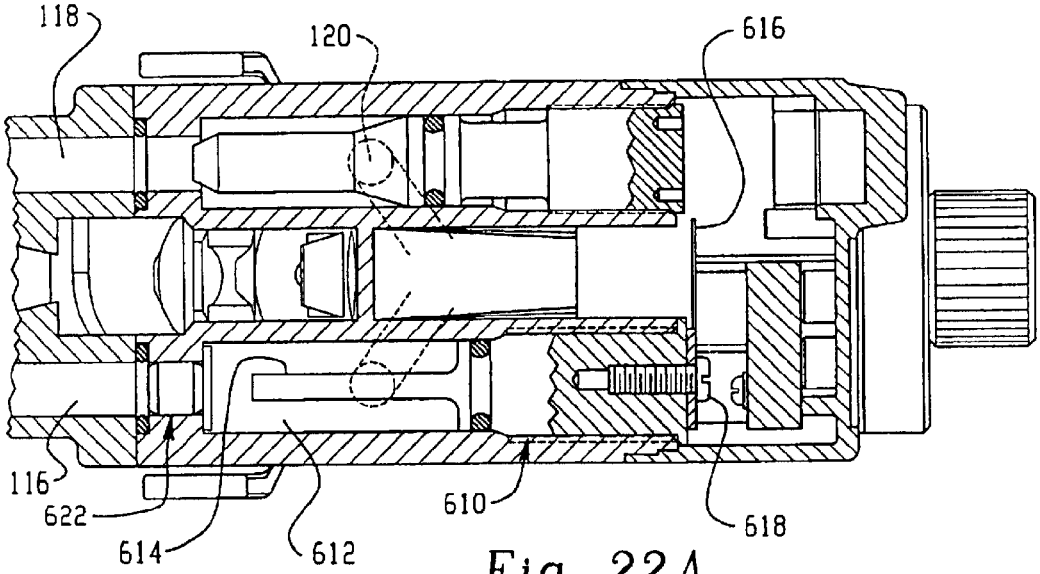
FIGS. 22A and 22B illustrate a heat sink for cooling a power supply mounted in the gun body using atomizing air.
Figure 22B:
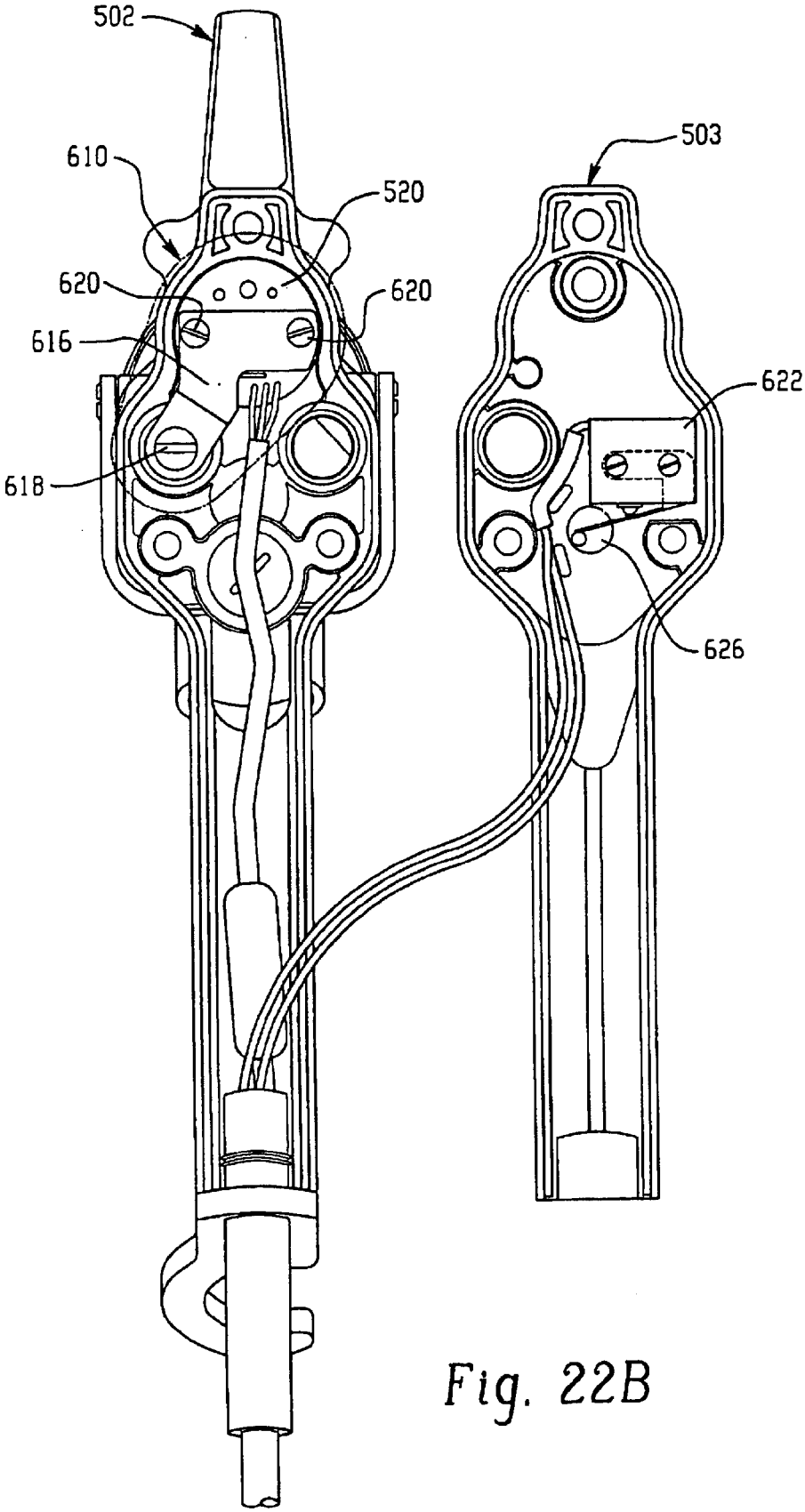

With reference to FIGS. 22A and 22B, the electrostatic modular spray gun further includes a heat sink assembly 610 for the multiplier 520. As with the above described non-electrostatic gun designs, atomizing air may also be used with the electrostatic version. When the air valve 510 (FIG. 18) is opened by actuation of the trigger 508, compressed air enters an atomizing air passage 612 and passes through the extension 504 to the atomizing component 506. A heat sink plug 614 is exposed to the flow of the compressed atomizing air. A cooling plate 616 is attached to the heat sink plug 614 such as with a screw 618. The plate 616 is also attached as by screws 620 to the back end face of the multiplier 520 (FIG. 22B). In this manner, heat is conducted away from the multiplier 520 with the plate 616 and heat sink plug 614 being cooled by the compressed atomizing air flow.

With continued reference to FIG. 22A, the atomizing air flow passage 612 may be provided with an optional restrictor plug 622. This plug simply reduces the air flow depending on the amount of restriction through the atomizing air chamber 118, thus allowing different pressures to be used for atomizing air and horn air. This is especially useful, for example, in HVLP applications, as previously described herein with respect to FIGS. 7 and 7A. Because of the incorporation of the heat sink 616 in the electrostatic gun version 500, the use of an adjustment valve 700 (FIG. 7A) is less practical. However, the size of the restrictor plug can be selected to reduce the atomizing air flow in a similar manner to thereby increase available horn air through the horn air chamber 116 for improved spray pattern control.

With reference again to FIG. 18, the back end of the gun body 502 includes an on/off electrical switch 622 for the low voltage input to the multiplier 520. By providing an electrical switch on the gun body, the operator can easily switch between electrostatic and non-electrostatic operation of the gun 500. The switch 622 in this case may be any suitable commercially available switch, with the switch 622 being actuated by a quarter-turn knob 624 that is mechanically connected to the switch 622 via a cam plate 626.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An electrostatic spray gun, comprising:

a fluid tip having a fluid flow path and a discharge orifice through which fluid is dispensed;

an air cap having one or more passages for spraying air onto said fluid dispensed from said fluid tip to atomize said fluid, said air cap being retained on said fluid tip by a retainer;

a valve element that opens and closes said orifice, said valve element having a charging electrode extending therefrom, said electrode extending through said orifice, said valve element containing an electrical resistor having first and second ends, said electrode being electrically coupled to said first end of said resistor, an electrical circuit containing one or more electrical conductors within said valve element, said electrical circuit being electrically coupled to said second end of said resistor, a part of said electrical circuit extending out of said valve element and comprising an electrical contact member;

and a conductive element secured within said fluid tip; said conductive element being in electrical contact with said contact member to provide a part of a conductive pathway extending from a power supply for said gun to said charging electrode for said gun.

2. The spray gun of claim 1 wherein said fluid flow path extends along an axis through said orifice, said electrode being off axis from said orifice.

3. The valve of claim 1 wherein said fluid tip is molded and said conductive element is molded into said fluid tip.

4. The valve of claim 1 wherein said conductive element is annular.

5. The valve of claim 4 wherein said conductive element includes a radially extending contact portion.

6. The valve of claim 1 wherein said conductive element is located in a rearward portion of said fluid tip.

7. The valve of claim 1 wherein said conductive element makes contact with a second conductive element secured to said fluid tip.

8. The valve of claim 7 wherein said second conductive element comprises a conductive ring which encircles said fluid tip.

9. The electrostatic spray gun of claim 1 wherein said conductive element maintains contact with said contact member as said valve element is retracted away from said orifice to allow fluid to be discharged therefrom.

10. The electrostatic spray gun of claim 9 wherein said conductive element maintains sliding contact with said contact member as said valve element is retracted.

* * * * *

UNITED STATES PATENT AND TRADEMARK OFFICE

CERTIFICATE OF CORRECTION

PATENT NO. : 6,877,681 B2
DATED : April 12, 2005
INVENTOR(S) : Hartle et al.

It is certified that error appears in the above-identified patent and that said Letters Patent is hereby corrected as shown below:

Title page,
Item [63], Related U.S. Application Data, delete the word "Nov." and insert -- Oct. --.

Signed and Sealed this

Twenty-third Day of August, 2005

JON W. DUDAS
*Director of the United States Patent and Trademark Office*